US007878498B2

(12) United States Patent
Niioka et al.

(10) Patent No.: US 7,878,498 B2
(45) Date of Patent: Feb. 1, 2011

(54) MEDIUM TRANSPORT APPARATUS

(75) Inventors: Koji Niioka, Tatsuno-machi (JP); Takuya Yasue, Matsumoto (JP); Hitoshi Igarashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 29 days.

(21) Appl. No.: 11/903,819

(22) Filed: Sep. 25, 2007

(65) Prior Publication Data

US 2008/0073831 A1 Mar. 27, 2008

(30) Foreign Application Priority Data

Sep. 25, 2006 (JP) ..... 2006-259083

(51) Int. Cl.
*B65H 5/00* (2006.01)

(52) U.S. Cl. ..... 271/10.02; 271/9.13; 271/264; 271/4.02; 271/4.03

(58) Field of Classification Search ..... 271/3.17, 271/4.02, 4.03, 10.02, 9.13, 264, 265.01, 271/258.01

See application file for complete search history.

(56) References Cited

U.S. PATENT DOCUMENTS

| | | | | |
|---|---|---|---|---|
| 4,557,473 | A * | 12/1985 | Pecak | 271/229 |
| 5,451,043 | A * | 9/1995 | Arai | 271/122 |
| 5,594,486 | A * | 1/1997 | Kiyohara | 347/104 |
| 5,975,523 | A * | 11/1999 | Suzuki | 271/242 |
| 6,038,836 | A | 3/2000 | Focke et al. | |
| 6,364,556 | B1 * | 4/2002 | Barbera et al. | 400/708 |
| 6,588,740 | B2 * | 7/2003 | Brugger et al. | 271/10.03 |
| 6,794,633 | B2 * | 9/2004 | Iwasaki | 250/221 |

FOREIGN PATENT DOCUMENTS

| | | |
|---|---|---|
| JP | 61-178339 | 8/1986 |
| JP | 61-182589 | 8/1986 |
| JP | 04-246036 | 9/1992 |
| JP | 8-58168 | 3/1996 |
| JP | 08-259037 | 10/1996 |
| JP | 11-11426 | 1/1999 |
| JP | 2000-296942 | 10/2000 |
| JP | 2001-266216 | 9/2001 |
| JP | 2006-247884 | 9/2006 |

* cited by examiner

*Primary Examiner*—Stefanos Karmis
*Assistant Examiner*—Ernesto Suarez
(74) *Attorney, Agent, or Firm*—Nutter McClennen & Fish LLP; John J. Penny, Jr.; Rory P. Pheiffer

(57) ABSTRACT

A medium transport apparatus including a medium detection sensor having a light-emitting unit and a light-receiving unit that are arranged apart from each other by a predetermined distance, and that changes the signal level of a detection signal output from the light-receiving unit according to the presence/non-presence of a medium between the light-emitting unit and the light-receiving unit, and a medium guide member that is arranged in the middle of a transport path for the medium to guide the medium, and that has a medium guide face for guiding the medium, and a sensor attachment so that the medium guide face may be arranged at a position closer to either the light-emitting unit or the light-receiving unit.

4 Claims, 13 Drawing Sheets

MEDIUM TRANSPORT APPARATUS

BACKGROUND OF THE INVENTION

1. Field of the Invention

The present invention relates to a medium transport apparatus.

2. Description of the Related Art

Medium transport apparatuses are apparatuses for transporting a medium, such as a sheet, and are realized as, for example, printing apparatuses. Also, in such printing apparatuses serving as medium transport apparatuses, a medium detection sensor for detecting a medium is typically provided. As an example of such a medium detection sensor, there is a sensor having a lever that is rotatably arranged in the middle of a transport path of a medium and a photo-interrupter that changes the signal level of a detection signal in accordance with operation of this lever (see JP-A-8-259037).

When the medium detection sensor that has a lever and a photo-interrupter is used, a space in which this medium detection sensor can be attached is needed. As a result, there is a problem that this sensor is not suitable for miniaturization of medium transport apparatuses. Here, a configuration in which a medium is directly detected by a photo-interrupter is considered in order to achieve miniaturization. However, in the configuration in which the photo-interrupter is simply used in this way, a medium may become caught in the photo-interrupter and hindrance to transport may occur.

SUMMARY OF THE INVENTION

An advantage of the invention is that it provides a medium transport apparatus capable of achieving miniaturization and smoothly transporting a medium.

According to an aspect of the invention, a medium transport apparatus includes: (A) a medium detection sensor having a light-emitting unit and a light-receiving unit that are arranged apart from each other by a predetermined distance, and that changes the signal level of a detection signal output from the light-receiving unit according to the presence/non-presence of a medium between the light-emitting unit and the light-receiving unit; and (B) a medium guide member that is arranged in the middle of a transport path for the medium to guide the medium, and that has a medium guide face for guiding the medium, and a sensor attachment portion to which the medium detection sensor is attached so that the medium guide face may be arranged at a position closer to either the light-emitting unit or the light-receiving unit.

Other features of the invention will become apparent from the disclosure of the present specification and the accompanying drawings.

BRIEF DESCRIPTION OF THE DRAWINGS

The invention will be described with reference to the accompanying drawings, wherein like numbers reference like elements.

DETAILED DESCRIPTION OF EXEMPLARY EMBODIMENTS

Figure 1:
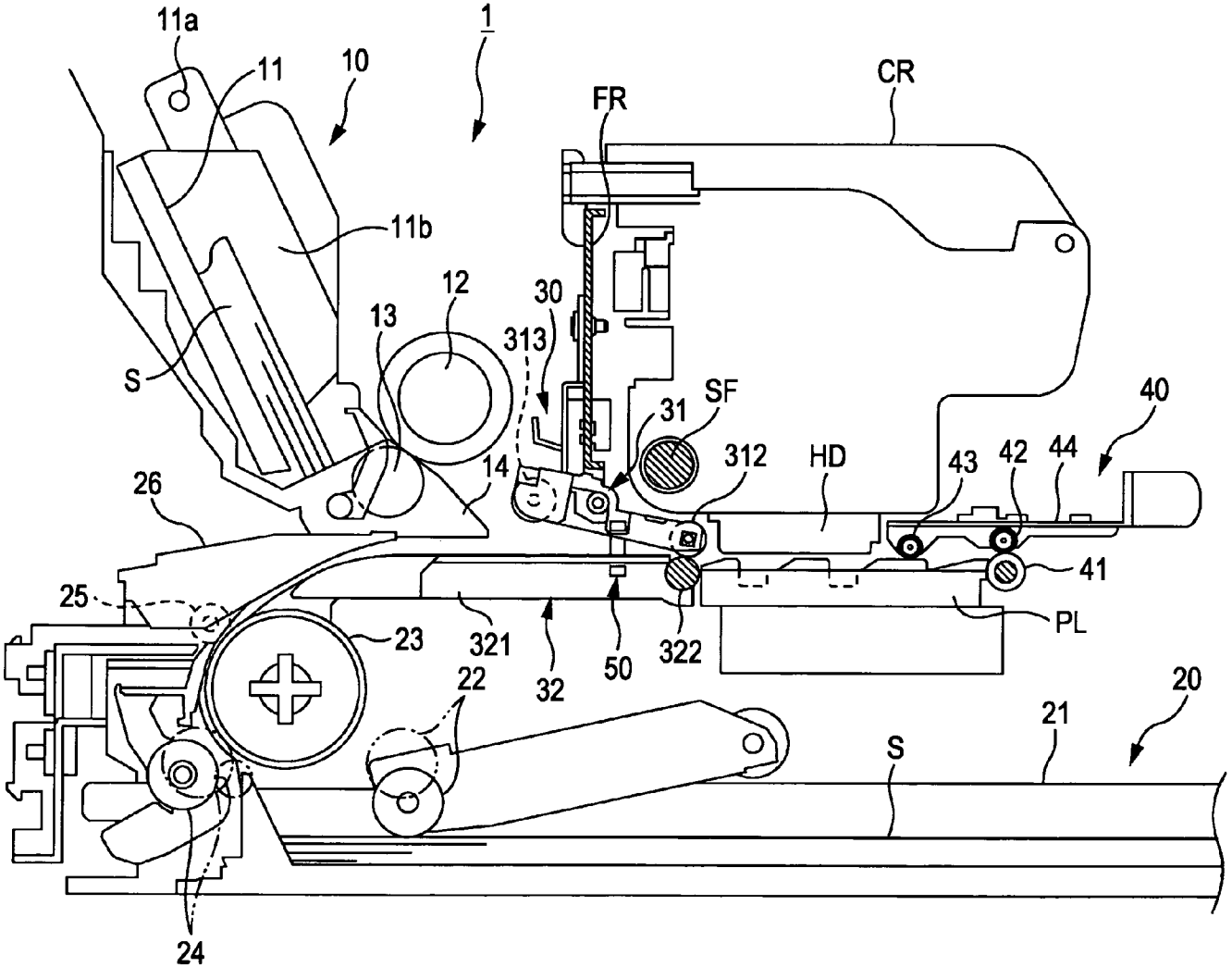
FIG. 1 is a side view illustrating the internal configuration of a printer.

At least the following matters will become apparent from the disclosure of the present specification and the accompanying drawings.

That is, it is apparently possible to realize a medium transport apparatus including: (A) a medium detection sensor having a light-emitting unit and a light-receiving unit that are arranged apart from each other by a predetermined distance, and that changes the signal level of a detection signal output from the light-receiving unit according to the presence/non-presence of a medium between the light-emitting unit and the light-receiving unit; and (B) a medium guide member that is arranged in the middle of a transport path for the medium to guide the medium, and that has a medium guide face for guiding the medium, and a sensor attachment portion to which the medium detection sensor is attached so that the medium guide face may be arranged at a position closer to either the light-emitting unit or the light-receiving unit.

According to such a medium transport apparatus, because the medium guided between the light-emitting unit and the light-receiving unit by the medium guide face is detected directly, miniaturization of the apparatus can be achieved. Further, because the medium guide face is arranged at a position closer to either the light-emitting unit or the light-receiving unit, catching of a medium can be prevented.

In this medium transport apparatus, preferably, the medium guide member has a guide member body provided with the sensor attachment portion; and a guide rib that is provided in a transport direction of the medium with respect to the guide member body and that has the medium guide face formed on the side opposite the guide member body.

According to such a medium transport apparatus, because the medium guide face is provided in the guide rib, the area of a medium contacting the medium guide face can be reduced. Thereby, the medium can be transported smoothly.

In this medium transport apparatus, preferably, a near-side end of the guide rib in the transport direction of the medium is provided with an oblique guide face that connects the surface of the guide member body and the medium guide face.

According to such a medium transport apparatus, because the oblique guide face is provided, a medium can be smoothly transported between the surface of the guide member body, and the medium guide faces along this oblique guide face.

In this medium transport apparatus, preferably, the guide rib is integrally molded with the guide member body.

According to such a medium transport apparatus, because the guide rib is integrally molded with the guide member body, a medium can be transported smoothly.

In this medium transport apparatus, preferably, a plurality of the guide ribs are formed in an intersection direction that intersects the transport direction of the medium.

According to such a medium transport apparatus, because a plurality of guide ribs are formed in the intersection direction, the posture of a medium can be stabilized.

In this medium transport apparatus, preferably, the sensor attachment portion is constituted by a space into which either the light-emitting unit or the light-receiving unit is inserted, and the guide member body has an opening portion for allowing the light-emitting unit or light-receiving unit in a state of being attached to the sensor attachment portion to be exposed through the medium guide face.

According to such a medium transport apparatus, simplification of the configuration of sensor attachment portion can be achieved, and manufacture becomes easy.

In this medium transport apparatus, preferably, the sensor attachment portion is constituted by a space into which either the light-emitting unit or the light-receiving unit is inserted, and the guide member body has a communication hole that extends to the space and allows the light-emitting unit or light-receiving unit in a state of being attached to the sensor attachment portion to be exposed through the medium guide face.

According to such a medium transport apparatus, simplification of the configuration of the sensor attachment portion can be achieved, and manufacture becomes easy.

In this medium transport apparatus, preferably, the edge of the communication hole on the side of the medium guide faces is chamfered.

According to such a medium transport apparatus, a problem that a medium is caught by the edge of the communication hole can be prevented.

In this medium transport apparatus, preferably, the medium guide member has a rear-face-side medium guide member that guides the medium on the side of the rear face of the medium, and a front-face-side medium guide member that guides the medium on the side of the front face of the medium.

According to such a medium transport apparatus, because a medium is guided on the side of the rear face and front face thereof, the medium can be guided with certainty.

Such a medium transport apparatus preferably further includes a transport roller that transports the medium, and a press roller that presses the medium against the transport roller. Here, the front-face-side medium guide member has a roller attachment portion for attaching the press roller, and the medium guide member is rotatably attached so as to move the press roller attached to the roller attachment portion, in a direction of being pressed against the transport roller, and in a direction away from the transport roller.

According to such a medium transport apparatus, because the press roller is attached to the front-face-side medium guide member, miniaturization of the apparatus can be achieved.

In this medium transport apparatus, preferably, the front-face-side medium guide member is arranged above the rear-face-side medium guide member, and the medium detection sensor is adapted such that the light-emitting unit is arranged on the side of the rear-face-side medium guide member side, and the light-receiving unit is arranged on the side of the front-face-side medium guide member.

According to such a medium transport apparatus, because the light-receiving unit is arranged on the upper side and the light-emitting unit is arranged on the lower side, influence of outside light can be hardly influenced.

Further, it is apparently possible to realize the following medium transport apparatus.

That is, it is apparently possible to realize a medium transport apparatus including: (A) a medium detection sensor that has a light-emitting unit having a light-emitting element and a light-receiving unit having a light-receiving element that are arranged apart from each other by a predetermined distance, and that changes the signal level of a detection signal output from the light-receiving element according to the presence/non-presence of a medium between the light-emitting unit and the light-receiving unit; (B) a medium guide member that is arranged in the middle of a transport path for the medium to guide the medium, and that has a near-side guide piece arranged nearer to the near side in the transport direction of the medium than either the light-emitting unit or the light-receiving unit; and (C) a film member that covers a gap between either the light-emitting unit or the light-receiving unit and the near-side guide piece.

According to such a medium transport apparatus, because the medium detection sensor directly detects the medium guided between the light-emitting unit and the light-receiving unit, miniaturization of the device can be achieved. Further, because a gap between either the light-emitting unit or the light-receiving unit and the near-side guide piece is covered with a film member, a medium can be guided by the film member, and thus the medium can be transported smoothly.

In this medium transport apparatus, preferably, the film member is bonded to each of either the light-emitting unit or the light-receiving unit and the near-side guide piece.

According to such a medium transport apparatus, the film member can be attached with certainty.

In this medium transport apparatus, preferably, the film member is bonded to the near-side guide piece, and the gap between either the light-emitting unit or the light-receiving unit and the near-side guide piece is covered with a non-adhesion portion in the film member.

According to such a medium transport apparatus, the degrees of freedom in arrangement of either the light-emitting unit or the light-receiving unit can be improved.

In this medium transport apparatus, preferably, the medium guide member has a deep-side guide piece that is arranged nearer to the deep side in the transport direction of the medium than either the light-emitting unit or the light-receiving unit, and the film member is laid between the near-side guide piece, and the deep-side guide piece.

According to such a medium transport apparatus, the gap can be covered with certainty.

In this medium transport apparatus, preferably, the film member is wound so as to cover the near-side guide piece and the deep-side guide piece, and is fixed opposite the side where the other of the light-emitting unit and the light-receiving unit is located.

According to such a medium transport apparatus, a medium can be guided with certainty.

In this medium transport apparatus, preferably, the film member covers the gap between each of either the light-emitting unit or the light-receiving unit and the near-side guide piece, away from an optical axis that connects the light-emitting element and the light-receiving element.

According to such a medium transport apparatus, the detection sensitivity of a medium can be improved.

In this medium transport apparatus, preferably, the film member is made of a material having translucency, and covers the gap between each of either the light-emitting unit or the light-receiving unit and the near-side guide piece, so as to cover an optical axis that connects the light-emitting element and the light-receiving element.

According to such a medium transport apparatus, the light-emitting element and the light-receiving element can be protected.

Further, it is apparently possible to realize the following medium transport apparatus.

That is, it is apparently possible to realize a medium transport apparatus including: (A) a first transport unit that transports a medium along a first transport path towards a transporting member; (B) a second transport unit that transports the medium along a second transport path towards the transporting member; and (C) a medium detection sensor that has a light-emitting unit and a light-receiving unit that are arranged apart from each other by a predetermined distance, changes the signal level of a detection signal output from the light-receiving unit according to the presence/non-presence of a medium between the light-emitting unit and the light-receiving unit, and is disposed in a joint path where the first transport path and the second transport path is joined together.

According to such a medium transport apparatus, because the medium detection sensor directly detects the medium guided between the light-emitting unit and the light-receiving unit, miniaturization of the device can be achieved. Further, because the medium detection sensor detects the medium transported along the first transport path and the medium transported along the second transport path, simplification of the configuration can be achieved.

In this medium transport apparatus, preferably, the transporting member has a transport roller that transports the medium, and a press roller that presses the medium against the transport roller.

According to such a medium transport apparatus, because a medium is transported by two rollers, this is suitable for miniaturization of the apparatus.

In this medium transport apparatus, preferably, the first transport unit has a regulating member that regulates the transport direction of a medium transported in the first transport path, in a position opposite the transporting member with the medium detection sensor therebetween, and the medium detection sensor is arranged in a position within a range in which a virtual straight line that connects a regulating-member-side contact point where the medium contacts the regulating member nearest to the transporting member, and a transporting-member-side contact point where the transport roller and the press roller contact each other passes between the light-emitting unit and the light-receiving unit.

According to such a medium transport apparatus, a medium can be transported smoothly.

In this medium transport apparatus, preferably, the regulating member is a guide idler that rotates as the medium transported in the first transport path contacts.

According to such a medium transport apparatus, a medium can be smoothly transported by the guide idler.

Preferably, the medium transport apparatus further includes a supporting member that supports the press roller and the guide idler.

According to such a medium transport apparatus, because the press roller and the guide idler are supported by the common supporting member, this is suitable for miniaturization of the apparatus.

In this medium transport apparatus, preferably, the second transport unit is arranged in the middle of the second transport path, and has a guide rib provided with a medium guide face for guiding the medium, and the medium detection sensor is arranged between one end and the other end of the medium guide face in the transport direction.

According to such a medium transport apparatus, the medium transported along the second transport path is guided by the medium guide face when it passes through the medium detection sensor. Therefore, a medium can be detected with certainty.

In this medium transport apparatus, preferably, the guide rib is provided in a guide member body that has a sensor attachment portion to which either the light-emitting unit or the light-receiving unit is attached.

According to such a medium transport apparatus, simplification of the configuration of the sensor attachment portion can be achieved, and manufacture becomes easy.

In this medium transport apparatus, preferably, the first transport unit transports the medium, which is kept higher than the transporting member, along the first transport path towards the transporting member, and the second transport unit transports the medium, which is kept lower than the transporting member, along the second transport path towards the transporting member.

According to such a medium transport apparatus, it is suitable for miniaturization of the apparatus.

First Embodiment

Medium Transport Apparatus

A medium transport apparatus can be incorporated into various apparatuses. Here, an ink jet printer that is a kind of a printing apparatus (hereinafter simply referred to as a printer) will be described as an example. In this case, a sheet on which an image is to be printed corresponds to a medium, and a printer corresponds to the medium transport apparatus.

Entire Configuration of Printer 1

The printer 1 illustrated in FIG. 1 has a carriage CR, a first sheet feed unit 10, a second sheet feed unit 20, a junction guide unit 30, and a sheet discharge unit 40.

The carriage CR is moved in the width direction (direction orthogonal to the transport direction) of a sheet S along a guide shaft SF by a carriage moving mechanism (not shown). An ink cartridge (not shown) is held inside the carriage CR, and a head HD that discharges ink is attached to the bottom surface of the carriage CR. Further, a platen PL that supports a sheet S from its rear face (a surface opposite a face to be printed) is arranged in a position that faces the head HD.

First Sheet Feed Unit 10

The first sheet feed unit 10 is a unit that transports a sheet S as a medium along a first transport path towards a set (corresponding to a transporting member that transports a medium.) of a transport roller 322 and press rollers 312 of the junction guide unit 30, and constitutes a first transport unit along with the junction guide unit 30. The first sheet feed unit 10 has a first hopper 11, a first feed roller 12, a retardation roller 13, and a lower guide 14. The first hopper 11 is a member for holding a plurality of the sheets S. This first hopper 11 is constituted by a plate-like member, and is rotatably attached about a rotating shaft 11*a*. The sheets S are held in a stacked state on the surface side of the first hopper 11. In this held state, a sheet S is abutted against a lateral guide 11*b* at its lateral edge, and is held in a predetermined position. By rotating the first hopper 11 upward, the uppermost sheet S located at the uppermost position contacts the first feed roller 12, and is transported toward the junction guide unit 30. Further, as the first hopper 11 rotates downward, the first feed roller 12 is separated from the sheet S. Thereby, sheet S is not transported. The retardation roller 13 is provided for preventing double feed of sheets S. This retardation roller 13 is arranged so as to nip one sheet S in cooperation with the first feed roller 12. The double feed of sheets S is prevented by a torque limiter mechanism. The lower guide 14 is a member for guiding the sheet S transported from the first feed roller 12 towards the junction guide unit 30.

Second Sheet Feed Unit 20

The second sheet feed unit 20 is a unit that transports a sheet S along a second transport path towards the transport roller 322 and the press rollers 312, and constitutes a second transport unit along with the junction guide unit 30. The second sheet feed unit 20 has a sheet feed cassette 21, a pickup roller 22, a second feed roller 23, a separation roller 24, an assisting roller 25, and a second hopper 26. The sheet feed cassette 21 holds sheets S in a stacked state, and is configured such that it can be inserted from the front of the printer 1. The pickup roller 22 is provided for selectively transporting the sheet S, which is located at the uppermost position, from among the sheets S held in a stacked state in the sheet feed cassette 21. The second feed roller 23 further transports the sheet S transported by the pickup roller 22. By means of this second feed roller 23, the transport direction of sheet S is changed from a backward direction to an upward direction, and is then changed to a forward direction. The separation roller 24 is a roller for preventing double feed of sheets S, and nips one sheet S in cooperation with the second feed roller 23 to thereby transport the uppermost sheet S selectively. The assisting roller 25 is a roller for assisting transport of sheet S, and nips one sheet S in cooperation with the second feed roller 23 to thereby press the sheet S against the second feed roller 23. The second hopper 26 is provided for guiding sheet S that has passed through the assisting roller 25 towards the junction guide unit 30. In addition, this second hopper 26 also has a function to guide the sheet S sent from the front side of the printer 1 towards a reversing unit (not shown), when the reversing unit is mounted on the rear side of the printer 1.

As such, in the second sheet feed unit 20, a sheet S is held in a position lower than a platen PL or the junction guide unit 30, and one sheet S is transported along a semicircular path by the second feed roller 23. That is because the transport direction is reversed while one sheet S is moved upward, the length of an apparatus in the depth direction can be made small. That is, this configuration is suitable for miniaturization of the apparatus. Further, the problem that the first sheet feed unit 10 may intersect the sheet feed path of sheet S can also be prevented.

Junction Guide Unit 30

The junction guide unit 30 is provided for guiding the sheet S guided from the first sheet feed unit 10, or the sheet S guided from the second sheet feed unit 20 towards the head HD. In other words, the junction guide unit is a member that guides sheet S in a junction path where the first transport path from the first sheet feed unit 10, and the second transport path from the second sheet feed unit 20 are joined together. Accordingly, the range of the junction guide unit 30 corresponds to a junction path in the transport path (the first transport path and the second transport path) of sheet S. The junction guide unit 30 corresponds to a medium guide member that is arranged in the middle of the transport path of a sheet S to guide a medium. Further, the junction guide unit 30 also functions as a portion of the second transport unit while functioning as a portion of the first transport unit.

This junction guide unit 30 has a top guide member 31 and a bottom guide member 32. Here, the top guide member 31 is arranged higher than the bottom guide member 32. In other words, the top guide member is arranged on the same side as the head HD, i.e., on the side of the front surface of a sheet S (that is, on the side of a face to be printed), in the transport path of sheet S. Also, the top guide member 31 guides the sheet S to be transported on the side of the front face of the sheet. Therefore, the top guide member 31 corresponds to a front-face-side medium guide member that guides a medium on the front face of the medium. On the other hand, the bottom guide member 32 is arranged opposite the head HD (that is, on the side of the rear face of sheet S) in the transport path of sheet S. Therefore, the bottom guide member 32 corresponds to a rear-face-side medium guide member that guides a medium towards the rear face of the medium. By constituting the junction guide unit 30 with the top guide member 31 and the bottom guide member 32 in this way, a sheet S can be guided on the front and rear faces of one sheet S. Therefore, a sheet S can be guided with certainty.

Figure 11:
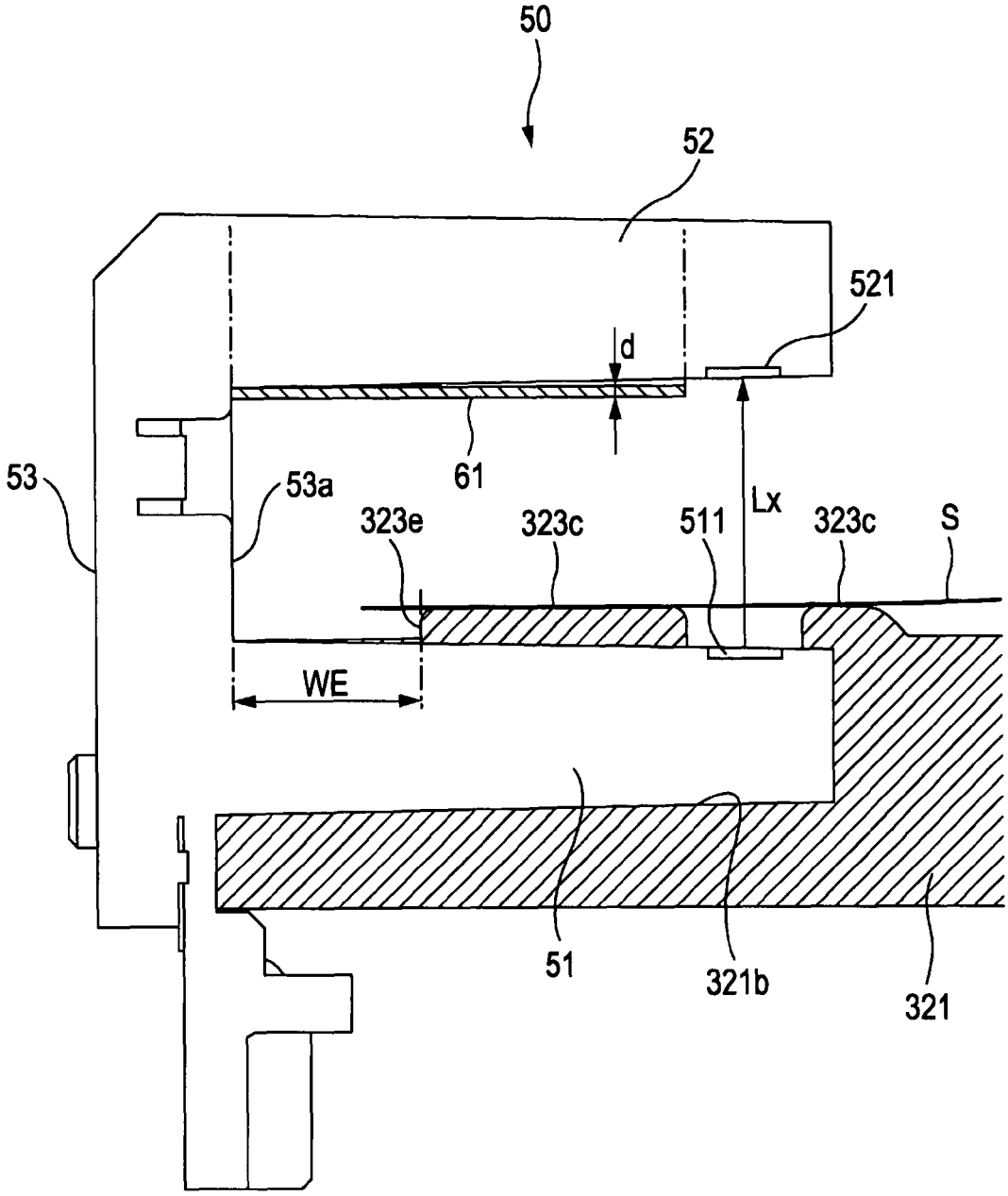
FIG. 11 is an enlarged view illustrating the sheet detecting sensor attached to the bottom guide member.

A sheet detecting sensor 50 for detecting a sheet S is attached to this junction guide unit 30. This sheet detecting sensor 50 is constituted by a photo-interrupter. For example, as shown in FIG. 11, the sheet detecting sensor 50 has a light-emitting unit 51 and a light-receiving unit 52 that are arranged so as to face each other, in a state of being separated from each other by a predetermined spacing. According to the presence/non-presence of any sheet S between the light-emitting unit 51 and the light-receiving unit 52, the signal level of a detection signal to be output from the light-receiving unit 52 is changed. In such a sheet detecting sensor 50, because a sheet S is directly detected using the light from the light-emitting unit 51, a location required for attachment of the sheet detecting sensor 50 can be made small. Therefore, miniaturization of the printer 1 can be achieved. In addition, the spacing between the light-emitting unit 51 and the light-receiving unit 52 is determined according to required detection sensitivity or the intensity of the light radiated from the light-emitting unit 51. Therefore, the aforementioned "a predetermined spacing" means spacing suitable for detection of a sheet S.

Figure 5:
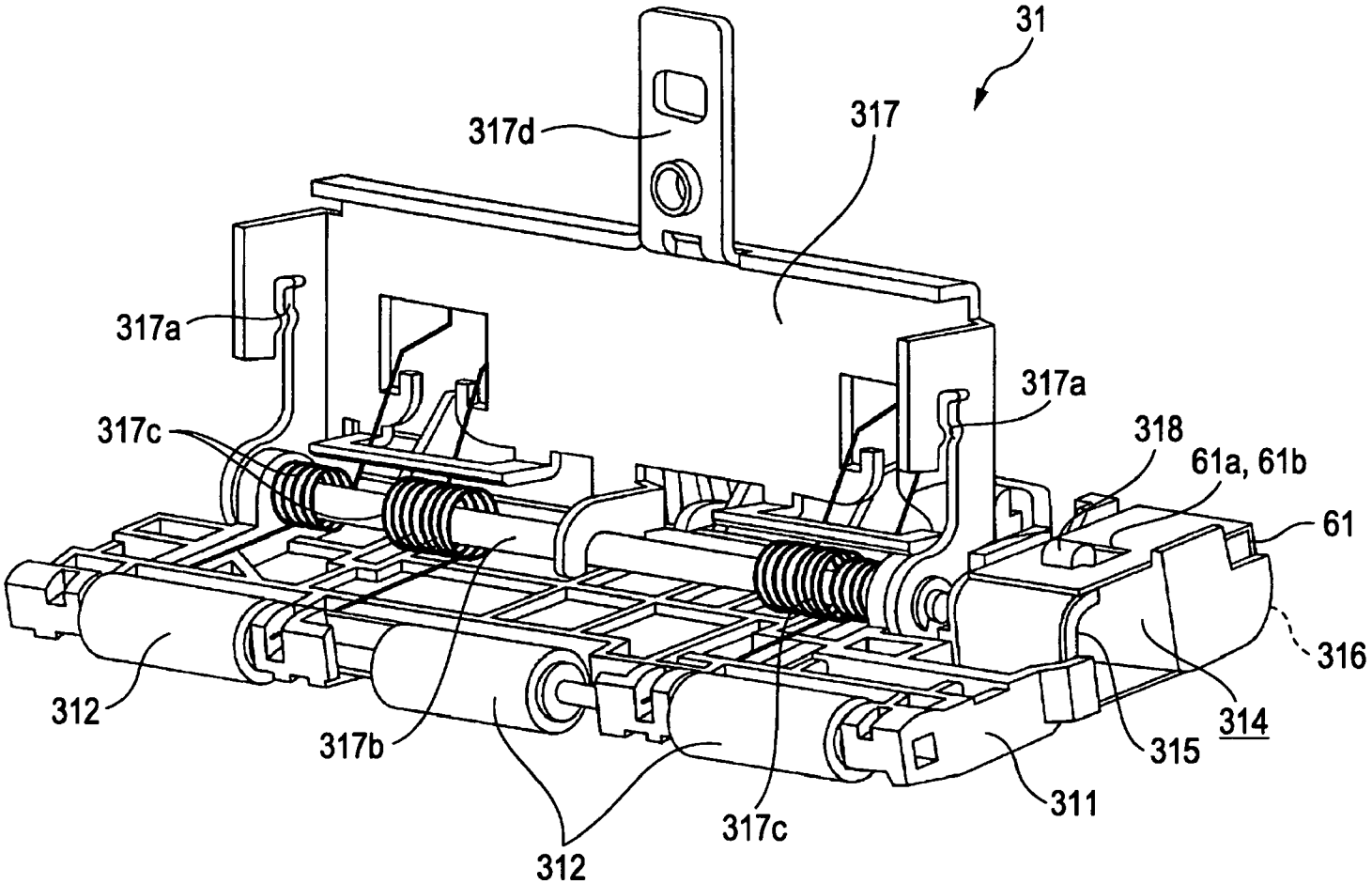
FIG. 5 is a view illustrating a top guide member, and an attachment portion of the sheet detecting sensor.

Further, as shown in FIG. 1, a set of the transport roller 322 and the press rollers 312 that function as transporting members are attached to the junction guide unit 30. The transport roller 322 is rotatably attached to the end (downstream end in the transport direction) of the bottom guide member 32 on the side of the head HD. This transport roller 322 is rotated by a transport motor (not shown). On the other hand, the press rollers 312, as shown in FIG. 5, are rotatably attached to a roller attachment portion provided at the end of the top guide member 31 on the side of the head HD. The press rollers 312 are arranged on the transport roller 322 in a state where they are pressed against the transport roller 322. If a transporting member is constituted by a set of the transport roller 322 and the press rollers 312, a sheet S can be transported by two rollers, which is suitable for miniaturization.

Further, a guide idler 313 is provided at the end of the top guide member 31 on the side of the first sheet feed unit 10, i.e., in a position opposite to the set of the transport roller 322 and press rollers 312 with the sheet detecting sensor 50 therebetween. This guide idler 313 mainly guides the sheet S sent from the first sheet feed unit 10. Therefore, the guide idler 313 corresponds to a regulating member that regulates the transport direction of the sheet S to be transported in the first transport path. In addition, the configuration of the junction guide unit 30 or the sheet detecting sensor 50 will be described later.

Paper Discharge Unit 40

A sheet discharge unit 40 is arranged on the downstream side of the head HD or platen P in the transport direction of sheet S. In addition, the transport direction in this case means the downstream side in the transport direction at the time of printing the sheet S. In this printer 1, it becomes possible to mount a reversing unit to print both sides of a sheet S. In that case, a sheet S is transported in a direction opposite to a print direction. The sheet discharge unit 40 transports the sheet S on which an image has been printed, towards the downstream side in the transport direction, at the time of printing of an image. Further, in special cases, such as reversing a sheet S or pulling out the head of a sheet S (positioning of a downstream end in the transport direction), a sheet S is transported in the opposite direction towards the upstream side in the transport direction.

In the illustrated printer 1, the sheet discharge unit 40 has a sheet discharge roller 41, a downstream driven roller 42, an upstream driven roller 43, and a frame 44. The sheet discharge roller 41 is rotatably attached to the downstream end of the platen PL in the transport direction. The downstream driven roller 42 is a circular saw-like roller, and is arranged in a rotatable state above the sheet discharge roller 41. The sheet S is transported while being nipped between the sheet discharge roller 41 and the downstream driven roller 42. The upstream driven roller 43 has the same configuration as the downstream driven roller 42. The upstream driven roller 43 is arranged on the upstream side of the downstream driven roller 42 in the transport direction, and guides a sheet S on the side of the front face of the sheet. The frame 44 rotatably supports the downstream driven roller 42 and the upstream driven roller 43.

Relationship Between Each Transport Path and Sheet Detecting Sensor 50

In this printer 1, the sheet detecting sensor 50 is arranged in the junction guide unit 30. This sheet detecting sensor 50 detects the sheet S guided along the first transport path from the first sheet feed unit 10, or the sheet S guided along the second transport path from the second sheet feed unit 20. By detecting the sheets S transported along the different transport paths by means of the common sheet detecting sensor 50 in this way, simplification of the configuration can be achieved. Hereinafter, the relationship between each transport path and the sheet detecting sensor 50 will be described.

Top guide member 31 and bottom guide member 32

Figure 2:
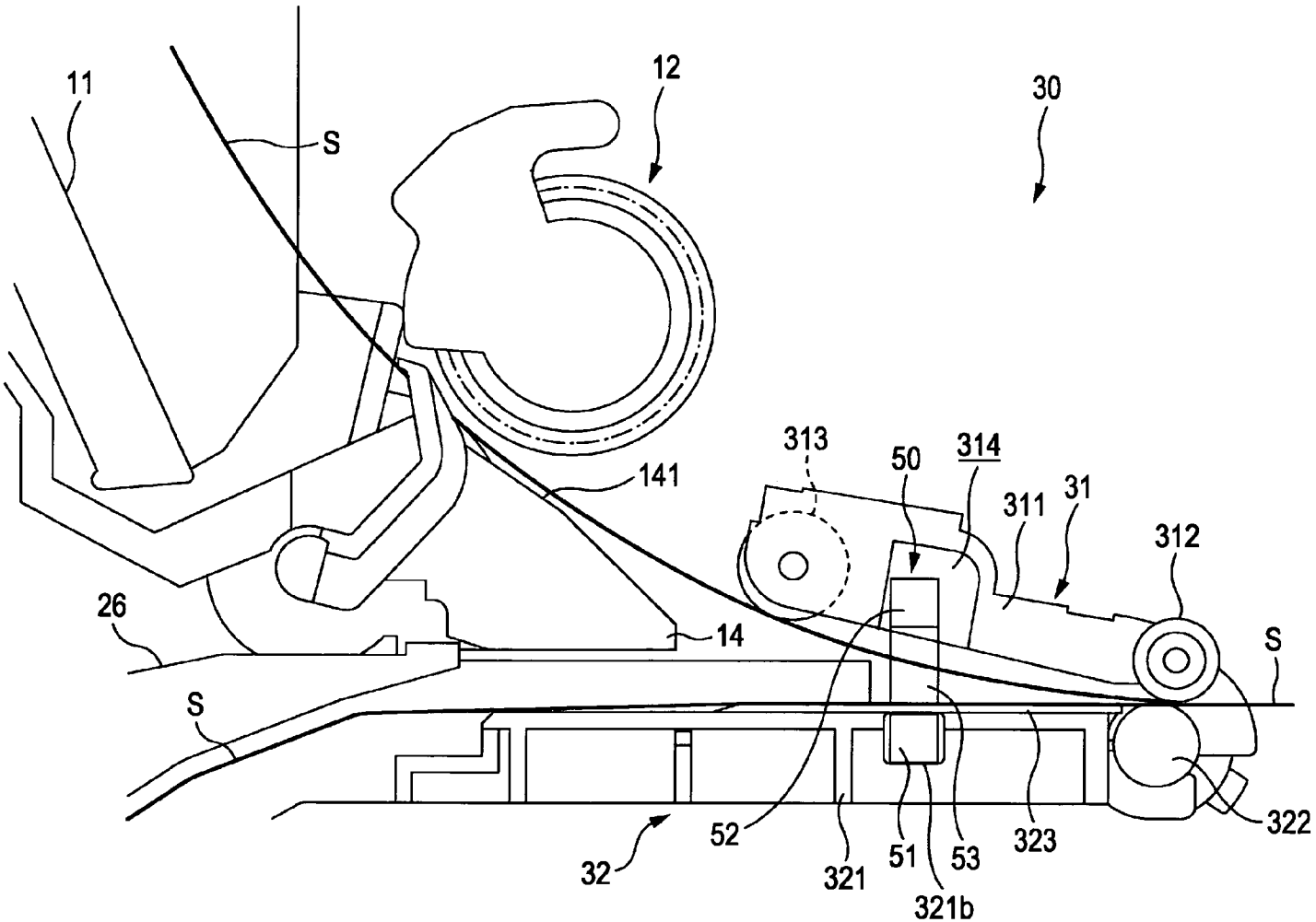
FIG. 2 is an enlarged view showing a junction guide unit and its surrounding portion.

As mentioned above, the junction guide unit 30 has the top guide member 31 and the bottom guide member 32. As shown in FIG. 2, the top guide member 31 has a holding frame 311 serving as a supporting member. Press rollers 312 are rotatably attached to the end of this holding frame 311 on the side of the head HD. Further, a guide idler 313 serving as a regulating member is attached to the end of the holding frame 311 on the side of the first sheet feed unit 10. Moreover, an arrangement space 314 where a portion of the sheet detecting sensor 50 is arranged is provided in the middle of an attachment portion for the press rollers 312 and an attachment portion for the guide idler 313, in the holding frame 311. In this example, a light-receiving unit 52 possessed by the sheet detecting sensor 50 is arranged in the arrangement space 314.

Further, the bottom guide member 32 has a guide member body 321 and guide ribs 323. The guide ribs 323 are provided in the guide member body 321. In this embodiment, the guide rib is provided by integral molding. The faces of the guide ribs 323 opposite the guide member body 321 constitutes sheet guide face 323*a* (corresponding to medium guide faces (refer to FIG. 7)) for guiding a sheet S. Moreover, as shown also in FIG. 9, the guide member body 321 is provided with a sensor attachment portion 321*b* to which the other portion of the sheet detecting sensor 50 is attached. The sensor attachment portion 321*b* in this embodiment is provided for attaching the light-emitting unit 51 possessed by the sheet detecting sensor 50. In this printer 1, the sensor attachment portion is constituted by the space formed in a direction orthogonal to the transport direction, i.e., a space of the shape formed after the outer shape of the light-emitting unit 51 is formed. Also, the sensor attachment portion 321*b* is provided between one end and the other end of the guide ribs 323 (sheet guide faces 323*a*) in the transport direction. Along with this, the sheet detecting sensor 50 is also arranged between one end and the other end of the sheet guide faces 323*a* in the transport direction. Sheet detecting sensor 50

Further, as shown also in FIG. 11, the sheet detecting sensor 50 has a structure in which a prismatic light-emitting unit 51 and a prismatic light-receiving unit 52 are connected together by a connecting portion 53, and has a substantially U-shaped structure as seen from the side. That is, by being connected by the connecting portion 53, the light-emitting unit 51 and the light-receiving unit 52 are arranged so as to face each other in a state where they are separated from each other by a predetermined spacing. Moreover, because a light-emitting element 511 possessed by the light-emitting unit 51, and a light-receiving element 521 possessed by the light-receiving unit 52 face each other, if no sheet S is present between the light-emitting element 511 and the light-receiving element 521, the light that is radiated from the light-emitting element 511 is received by the light-receiving element 521. Thereby, a signal having a voltage level according to the amount of light received is output from the light-receiving element 521. On the other hand, if any sheet S is present between the light-emitting element 511 and the light-receiving element 521, the light radiated by the light-emitting element 511 is interrupted by the sheet S, and is not received by the light-receiving element 521. Thereby, a signal having a voltage level according to the amount of light received is output from the light-receiving element 521. As such, a detection signal having a corresponding signal level is output from the sheet detecting sensor 50, on the basis of the presence/non-presence of the sheet S between the light-emitting unit 51 (light-emitting element 511) and the light-receiving unit 52 (light-receiving element 521).

Arrangement of Sheet Detecting Sensor 50

As shown in FIG. 2, the sheet S transported by the first feed roller 12 possessed by the first sheet feed unit 10 is guided along a guide face 141 of the lower guide 14. After one sheet S is slightly changed in the transport direction by the guide idler 313, the sheet S is guided to the transport roller 322 and the press rollers 312 through the sheet detecting sensor 50. Accordingly, the sheet S held by the first sheet feed unit 10 is guided obliquely downward towards the transport roller 322, etc. On the other hand, the sheet S transported to the backside of the printer 1 by the pickup roller 22 possessed by the second sheet feed unit 20 ascends along a circular-arc gap formed by a peripheral surface of the second feed roller 23, and a guide face of the second hopper 26. Then, the transport direction is changed over to the front side. Then, the sheet is guided along a surface 323*a* of the bottom guide member 32, i.e., a sheet guide face provided in the guide ribs 323, and is guided through the sheet detecting sensor 50 to the transport roller 322, etc. Therefore, after the sheet S held by the second sheet feed unit 20 is raised by the second feed roller 23, the sheet is transported almost horizontally.

Here, the light-emitting unit 51 and the light-receiving unit 52 possessed by the sheet detecting sensor 50 are arranged in positions that are separated from each other by a predetermined spacing in the vertical direction. It is necessary to set the spacing between the light-emitting unit 51 and the light-receiving unit 52 to a range where the light radiated from the light-emitting element 511 can be received by the light-receiving element 521, and the spacing cannot be made unnecessarily large. Further, the light-emitting unit 51 and light-receiving unit 52 are molded into a prismatic shape for reasons such as to realize the relationship of positioning the light-emitting element 511 and the light-receiving element 521 and to protect them from an external force. Here, when sheet S contacts the light-emitting unit 51 or the light-receiving unit 52, a problem such as a scratch being caused on the surface of sheet S may occur. Therefore, it is desirable that sheet S contacts neither the light-emitting unit 51 nor the light-receiving unit 52 with respect to the transport path (the first transport path) of the sheet S from the first sheet feed unit 10 and the transport path (the second transport path) of the sheet S from the second sheet feed unit 20.

Figure 3:
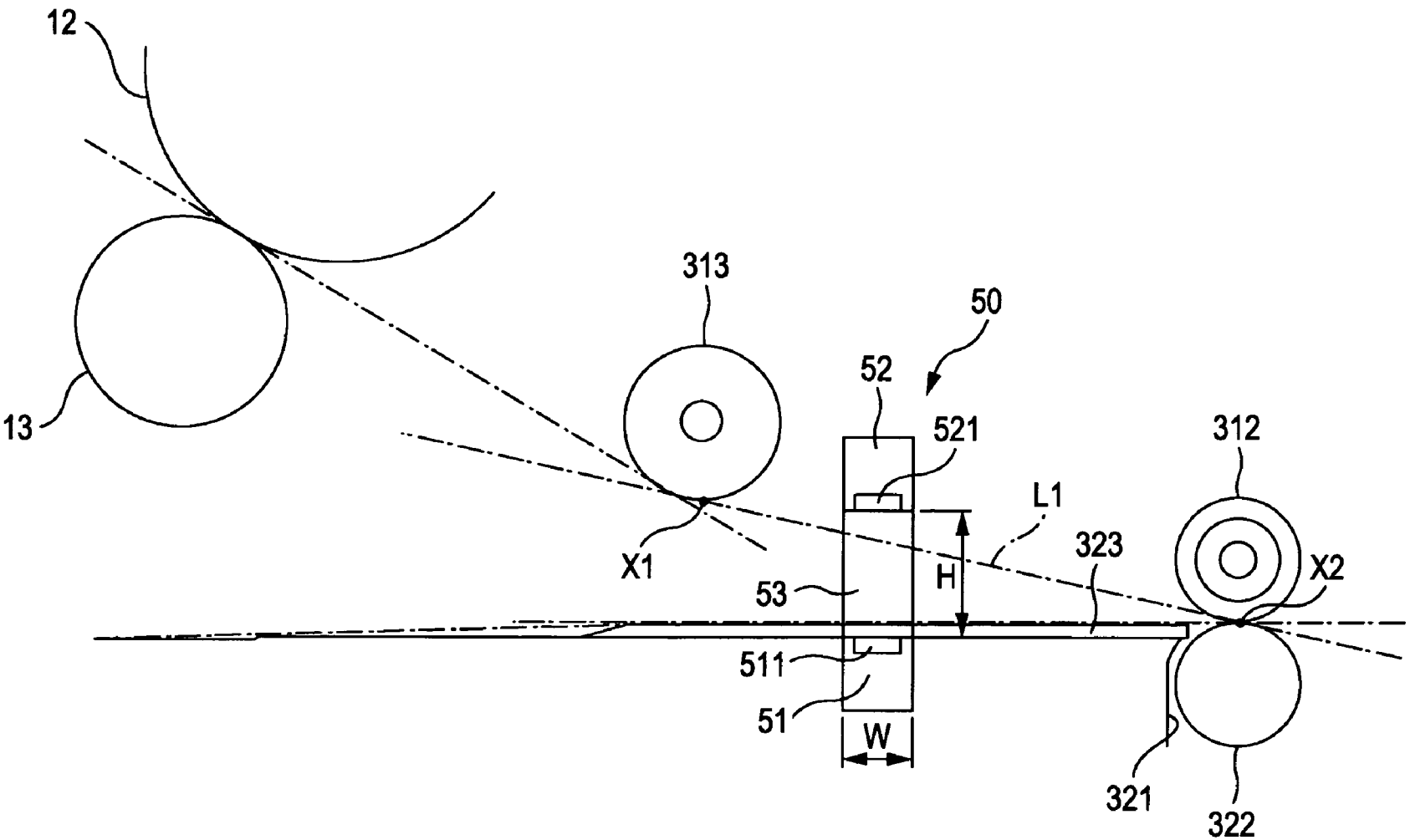
FIG. 3 is a schematic diagram for explaining the arrangement of a sheet detecting sensor.

Therefore, as schematically shown in FIG. 3, as for the first transport path that inclines downward towards the transport roller 322, the downward inclination angle is smaller than an angle that is determined by a ratio (H/W) of the distance H between the facing surfaces of the light-emitting unit 51 and light-receiving unit 52, and the width W of the light-emitting unit 51 and the light-receiving unit 52, and is larger than a horizontal level. In this printer 1, the angle of the first transport path is determined depending on the positional relationship between the set of the transport roller 322 and the press rollers 312, and the guide idler 313. Specifically, when a contact point X1 (corresponding to a regulating-member-side contact point) where sheet S contacts the guide idler 313 as a regulating member nearest to the transport roller 322, etc., and a contact point X2 (corresponding to the transporting-member-side contact point.) where the transport roller 322 and the roller 312 contact is defined, it can be said that a virtual straight line L1 that connects the contact point X1 and contact point X2 should just be within a range through which the straight line passes between the light-emitting unit 51 and the light-receiving unit 52 without contacting the light-emitting unit 51 and light-receiving unit 52.

Further, the second transport path is set almost horizontally along the sheet guide faces 323*a* possessed by the guide ribs 323. Therefore, it is desirable that the sheet guide faces 323*a* is located between the facing surface (arrangement surface of the light-emitting element 511) of the light-emitting unit 51, and the facing surface (arrangement surface of the light-receiving element 521) of the light-receiving unit 52. However, if the first transport path that is another transport path inclines downward like this embodiment, it is more preferable to bring the sheet guide faces 323*a* near to the lower facing surface. This is because the degree of freedom increases at a downward inclining angle in the first transport path.

Conclusion

As can be understood from the above description, in this printer 1, the sheet detecting sensor 50 is arranged in the junction path where the first transport path that is a transport path for sheet S from the first sheet feed unit 10, and the second transport path that is a transport path for sheet S from the second sheet feed unit 20 are jointed together. By this configuration, the sheet S transported along the first transport path and the sheet S transported the second transport path can be detected by the same sheet detecting sensor 50. As a result, simplification of the configuration can be achieved. Further, the sheet detecting sensor 50 is constituted by a photo-interrupter where the light-emitting unit 51 and the light-receiving unit 52 are arranged apart by a predetermined spacing. Therefore, if the sheet detecting sensor is positioned between the light-emitting unit 51 (light-emitting element 511) and the light-receiving unit 52 (light-receiving element 521), it can detect the presence/non-presence of sheet S irrespective of its position. In this point, detection precision (detection precision at the leading edge of sheet S) can be improved than a lever-type sensor. Attachment structure of sheet detecting sensor 50

Figure 4:
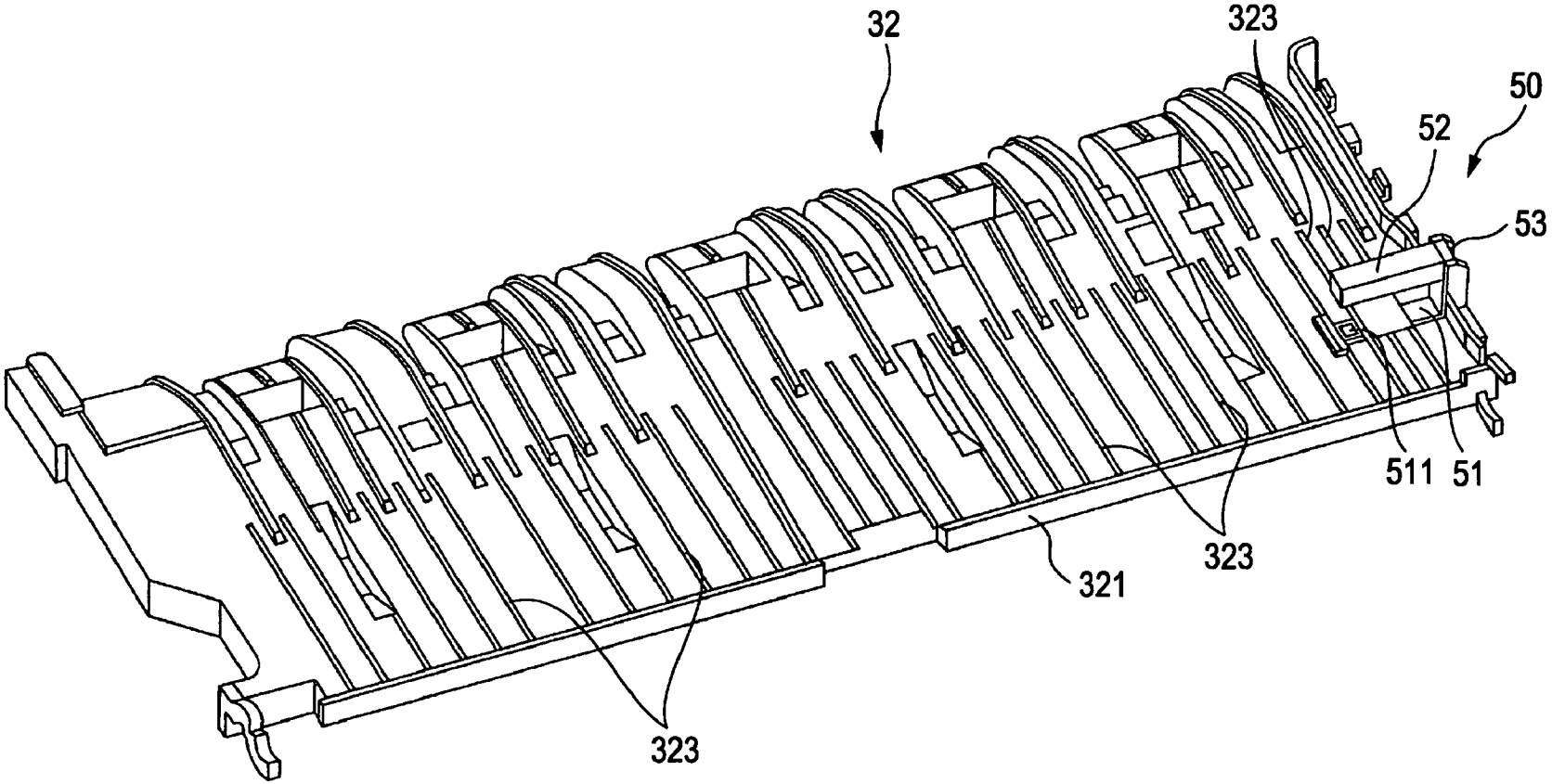
FIG. 4 is a view illustrating a bottom guide member, and the attachment position of the sheet detecting sensor.

In this printer 1, sheet S is detected by the sheet detecting sensor 50 that is constituted by a photo-interrupter. Here, in order to transport sheet S smoothly, it is necessary to prevent such a problem that sheet S is caught in the sheet detecting sensor 50. Hereinafter, a configuration for transporting sheet S smoothly will be described. Outline of attachment structure As shown in FIG. 4, the sheet detecting sensor 50 is attached to the sensor attachment portion 321*b* that is provided on a short side face of the guide member body 321. In this embodiment, the light-emitting unit 51 possessed by the sheet detecting sensor 50 is attached to the sensor attachment portion 321*b*. As a result, the light-emitting unit 51 is arranged on the lower side, and the light-receiving unit 52 is arranged on the upper side. As such, the reason why the light-emitting unit 51 is arranged on the lower side, and the light-receiving unit 52 is arranged on the upper side is because the influence of outside light is taken into consideration. If the light-receiving unit 52 is arranged on the lower side, there is a possibility that light (outside light) is incident from an illumination lamp arranged at a high place, such as a ceiling, and the light is received by the light-receiving unit 52. The influence of outside light can be reduced by arranging the light-receiving unit 52 on the upper side, and arranging the light-emitting unit 51 on the lower side, as in this embodiment. In addition, as long as there is no influence of outside light, the light-receiving unit 52 may be arranged on the lower side, and the light-emitting unit 51 may be arranged on the upper side. In other words, the light-receiving unit 52 may be attached to the sensor attachment portion 321*b*, and the light-emitting unit 51 may be arranged in the arrangement space 314.

Figure 7:
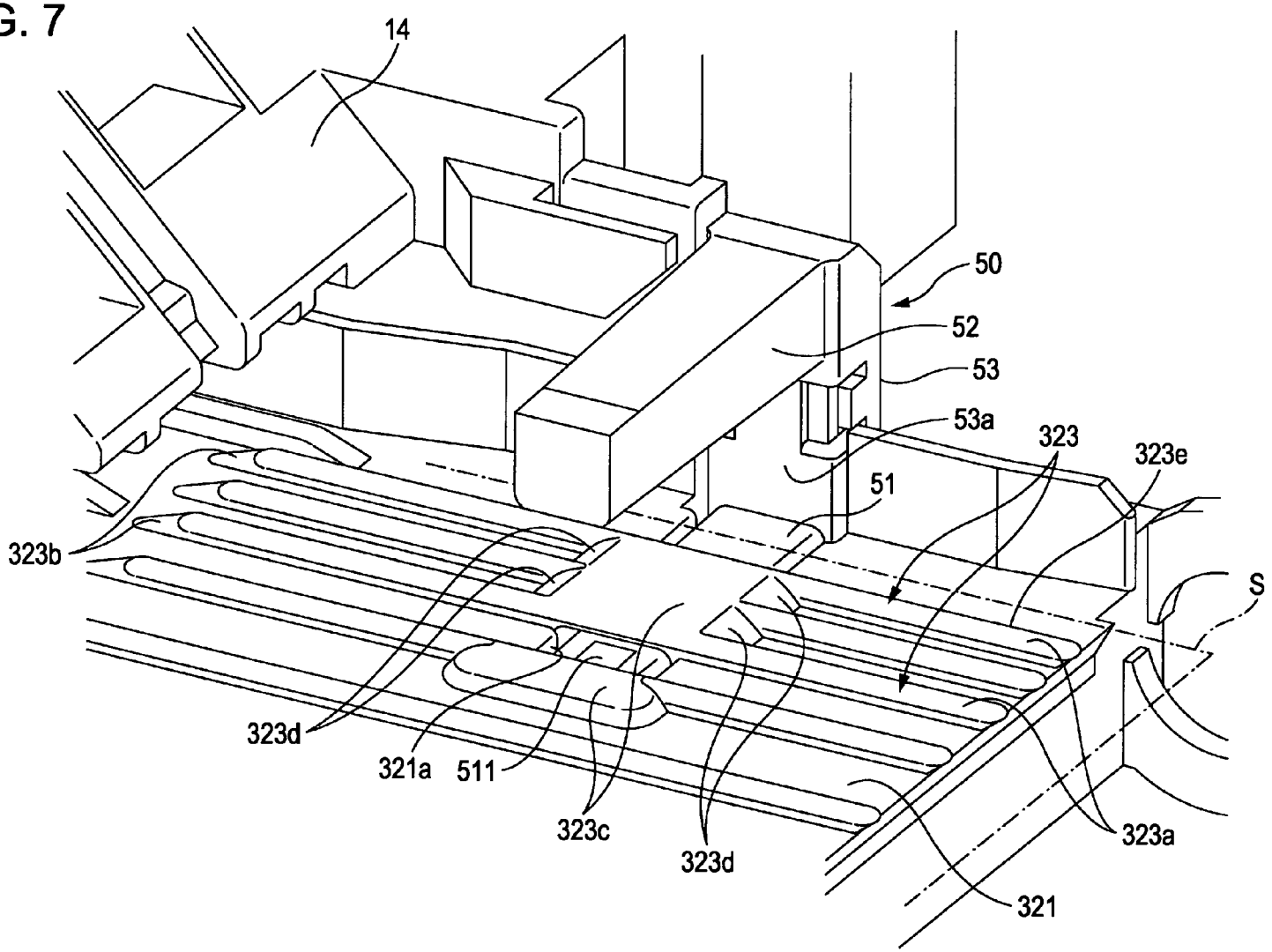
FIG. 7 is a view illustrating a state where a light-emitting unit is attached to the sensor attachment portion.

The sensor attachment portion 321*b* provided in the guide member body 321, as mentioned above, is constituted by the space into which the light-emitting unit 51 is inserted. Also, as shown in FIG. 7, the surface (the surface that faces sheet S) in the guide member body 321 is formed with a window hole 321*a* communicating with the sensor attachment portion 321*b*. This window hole 321*a* corresponds to an opening portion for allowing the light-emitting element 511 possessed by this light-emitting unit 51 to be exposed through the sheet guide faces 323*a* in a state where the light-emitting unit 51 is attached. Also, a plurality of guide ribs 323 that are elongate in the transport direction of sheet S are provided on the surface of the guide member body 321 in the width direction (corresponding to an intersection direction that intersects the transport direction) of sheet S.

Figure 6:
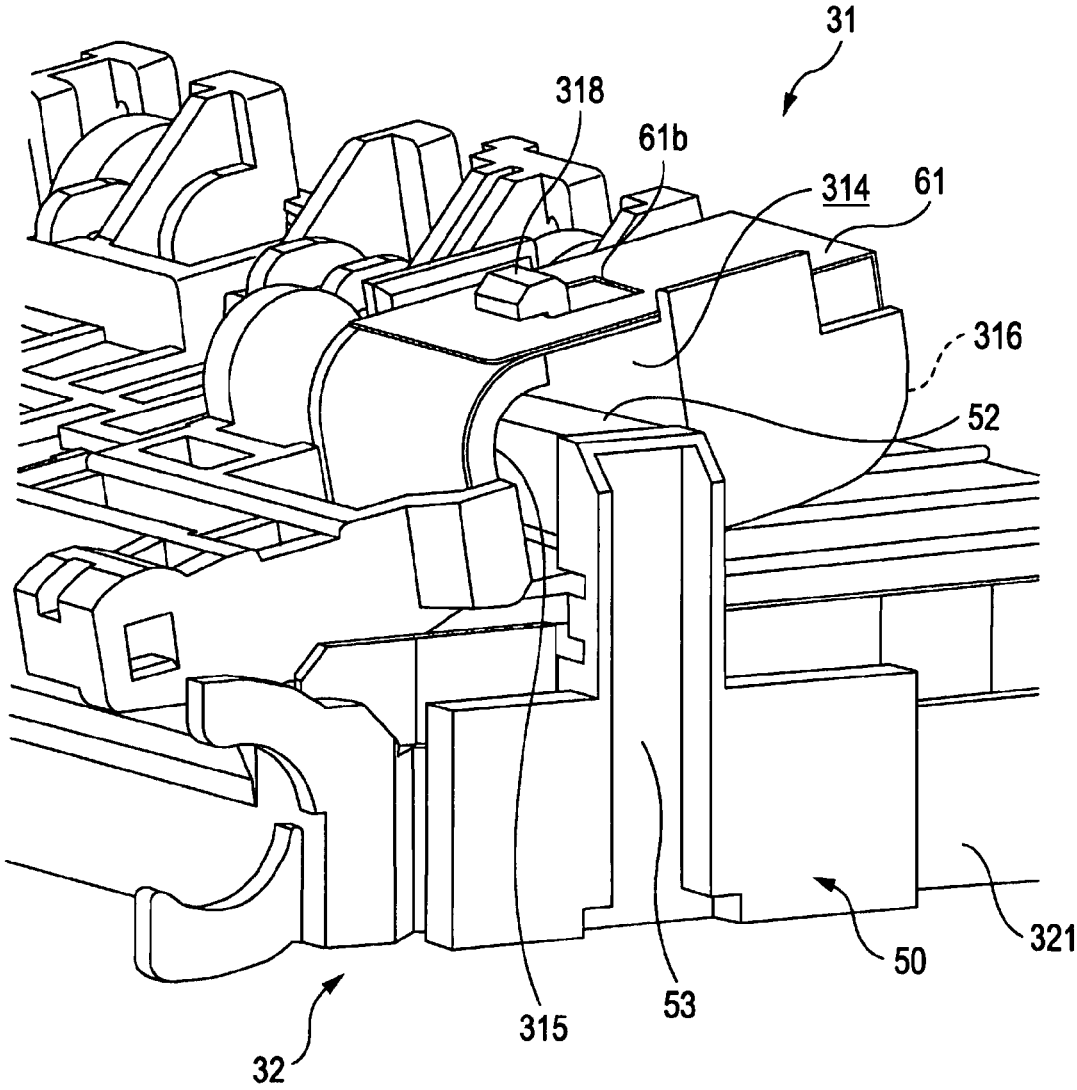
FIG. 6 is an enlarged view illustrating the attachment state of the sheet detecting sensor.

As shown in FIGS. 5 and 6, a side face of the top guide member 31 is formed with the arrangement space 314 where the light-receiving unit 52 possessed by the sheet detecting sensor 50 is arranged. The size of this arrangement space 314 is configured so as to be one round larger than the outer shape (square consisting of four side faces) of the light-receiving unit 52. This is because the top guide member 31 is rotatably attached to the frame 317 (base frame FR) in the attachment state shown in FIG. 1. In this example, the arrangement space 314 is provided in a position offset from a rotating shaft 317*b* that becomes the rotation center of the top guide member 31. Therefore, the arrangement space 314 will be moved relative to the light-receiving unit 52 by the rotation of the top guide member 31. In order to cope with this, this embodiment provides a structure in which the size of the arrangement space 314 is made larger than the outer shape of the light-receiving unit 52, and the light-receiving unit 52 is not fixed to the top guide member 31. As a result, even if the top guide member 31 has rotated, occurrence of hindrance can be prevented. For example, damage of the guide film 61 to be described can be prevented, or the positional deviation of the light-receiving unit 52 can be prevented.

Here, the attachment structure of the top guide member 31 will be described. The top guide member 31 is rotatably attached to the attachment frame 317. This attachment frame 317 is provided with attachment hooks 317*a*. If the attachment frame 317 is fixed to the base frame FR, for example, as shown in FIG. 1, a fixed piece 317*d* is hooked on the base frame FR, and thereafter, the attachment hooks 317*a* are screwed to the base frame FR. Further, the rotating shaft 317*b* is attached to the attachment frame 317, and bearings of the top guide member 31 are rotatably attached to this rotating shaft 317*b*. Also, the force of a direction in which the press rollers 312 move downward is applied to the top guide member 31 by torsion coil springs 317*c* attached to the rotating shaft 317*b*. Here, the press rollers 312 are in a state of riding on the transport roller 322, in a state where the top guide member 31 is attached, and there is no sheet S. Therefore, by the force applied from the torsion coil springs 317*c*, the top guide member 31 is rotated about the rotating shaft 317*b*, and the press rollers 312 are pressed against the transport roller 322. Further, when sheet S is transported, the top guide member 31 is rotated counterclockwise about the rotating shaft 317*b* against the force from the torsion coil springs 317*c*. Also, the press rollers 312 moves in a direction in which they are away from the transport roller 322, and nips sheet S along with the transport roller 322. Moreover, when sheet S passes between the press roller and the transport roller, the press rollers 312 will be pressed against the transport roller 322 by the force from the torsion coil springs 317*c*.

Structure on the Side of Bottom Guide Member 32

Guide Ribs 323 and Sensor Attachment Portion 321*b*

Next, the guide ribs 323 and the sensor attachment portion 321*b* possessed by the bottom guide member 32 will be described. In this embodiment, the bottom guide member 32 is manufactured by integral molding of resin. Therefore, it can be said that the guide ribs 323 and the sensor attachment portion 321*b* are integrally provided in the guide member body 321. If the bottom guide member is manufactured by integral molding of resin, manufacture becomes easy and efficiency is improved.

As shown in FIG. 7, the guide ribs 323 are constituted by portions that are swelled from the surface in the guide member body 321, i.e., the surface on the side of a transport path, and by long striped portions in the transport direction of sheet S. The surface opposite the guide member body 321 is provided with the sheet guide faces 323*a* in contact with the rear face of sheet S. Also, a plurality of guide ribs 323 are provided in a direction parallel to each other and orthogonal to the transport direction, i.e., the width direction of sheet S. Further, the guide ribs 323 are formed at the same height. As such, providing a plurality of guide ribs 323 whose heights are made flush is in order to guide a broad sheet S. That is, by providing a plurality of the striped guide ribs 323, which are elongate in the transport direction, in the width direction of sheet S, the area of contact with the rear face of sheet S can be reduced, and sheet S can be transported smoothly. Further, because the plurality of guide ribs 323 are provided, even in the case of sheets S having various kinds of width, any inclination in the width direction can be prevented, and the posture of sheet S can be stabilized. Further, oblique guide faces 323*b* that connect the surface of the guide member body 321 with the sheet guide faces 323*a* are provided at the illustrated guide ribs 323 at their ends on the side of the lower guide 14 (that is, at their ends on the near side in the transport direction). The oblique guide faces 323*b* are, for example, portions for guiding the sheet S transported in the second transport path from the second sheet feed unit 20 to the sheet guide faces 323*a*. In this embodiment, since the guide ribs 323 are provided by integral molding as mentioned above, the surface of the guide member body 321, the oblique guide faces 323*b*, and the sheet guide faces 323*a* can be formed without a joint. Thereby, sheet S is hardly caught, and can be transported smoothly.

Further, the sensor attachment portion 321*b* is constituted by a side face in the guide member body 321, i.e., a space in a direction orthogonal to the transport direction. In this embodiment, the sensor attachment portion 321*b* is constituted by a rectangular parallelepiped space formed after the shape of the light-emitting unit 51. Also, a portion of the sensor attachment portion 321*b* is opened to the guide ribs 323. Therefore, as shown also in FIG. 11, the face of the light-emitting unit 51 on the side of the light-emitting element 511 and the surface in the guide member body 321 are made almost the same height. By making the sensor attachment portion 321*b* into a space in this way, simplification of the configuration can be achieved, and manufacture becomes easy. Further, in this embodiment, a thick-walled portion is provided in a portion that corresponds to the sensor attachment portion 321*b*, i.e., a portion except a window hole 321*a* for allowing the light-emitting element 511 to be exposed. The thick-walled portions are provided for reinforcing the guide ribs 323, and are provided so as to cover the sensor attachment portion 321*b*. In the example of FIG. 7, the thick-walled portions 323*c* is provided so as to bury spaces between adjacent guide ribs 323 in three guide ribs 323 from the outside in an arranging direction. Further, with respect to the fourth guide rib 323 from the outside, other thick-walled portions 323*c* are provided in a state where they are overhung in the inner direction from the fourth guide rib 323. The surfaces of the thick-walled portions 323*c* are configured in series in a plane having the same height as the sheet guide faces 323*a*. These thick-walled portions 323*c* are manufactured by integral molding, similarly to the guide ribs 323. Therefore, the surfaces of the thick-walled portions 323*c* can be formed without any joint with the sheet guide faces 323*a*. Thereby, sheet S can be hardly caught, and can be transported smoothly.

Meanwhile, the sheet guide faces 323*a* and the surfaces of the thick-walled portions 323*c* are located in a position higher than the surface of the light-emitting unit 51 on the side of the light-emitting element 511. In other words, the sensor attachment portion 321*b* determines the arrangement of the sheet detecting sensor 50 so that the sheet guide faces 323*a* and the surfaces of the thick-walled portions 323*c* may be arranged in positions that are closer to the light-receiving unit 52 than the position of the light-emitting unit 51. Therefore, the sheet S transported along a transport path is prevented from being caught in the window hole 321*a* that faces the light-emitting element 511, due to the sheet guide faces 323*a*, etc. As a result, sheet S can be transported smoothly. In addition, in this embodiment, an inclined surface that is inclined downward from the surfaces of the thick-walled portions 323*c* to the surface of the guide member body 321 is provided. Since this inclined surface is also formed in series from the surfaces of the thick-walled portions 323*c* by integral molding, sheet S is hardly caught. As a result, sheet S can be transported smoothly.

Further, one lateral edge of sheet S (edge thereof in the width direction) in a transport state is regulated in position by the lateral guide 11*b* possessed by the first hopper 11. Thereby, as shown also in FIG. 11, the lateral edge of sheet S is positioned in a range WE from the side faces of the guide ribs 323 that are located at the outermost position to the surface of the connecting portion 53. In other words, the lateral edge of sheet S is located closer to the surface of the connecting portion 53 than the side faces of the guide ribs 323, and is arranged closer to the guide ribs 323 than the surface of the connecting portion 53. By such arrangement, a problem that sheet S may be caught by the guide ribs 323 or the connecting portion 53 can be prevented, and sheet can be transported smoothly.

Modified Example

Figure 8A:
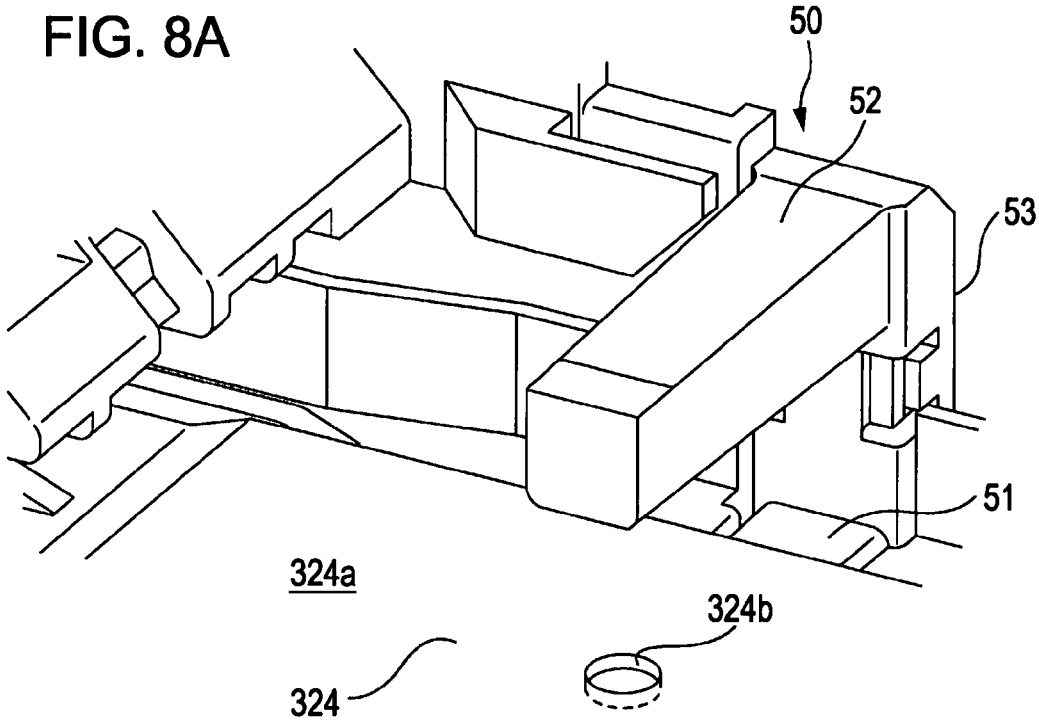
FIG. 8A is a view illustrating an example of a communication hole for allowing a light-emitting element to be exposed.
Figure 8B:
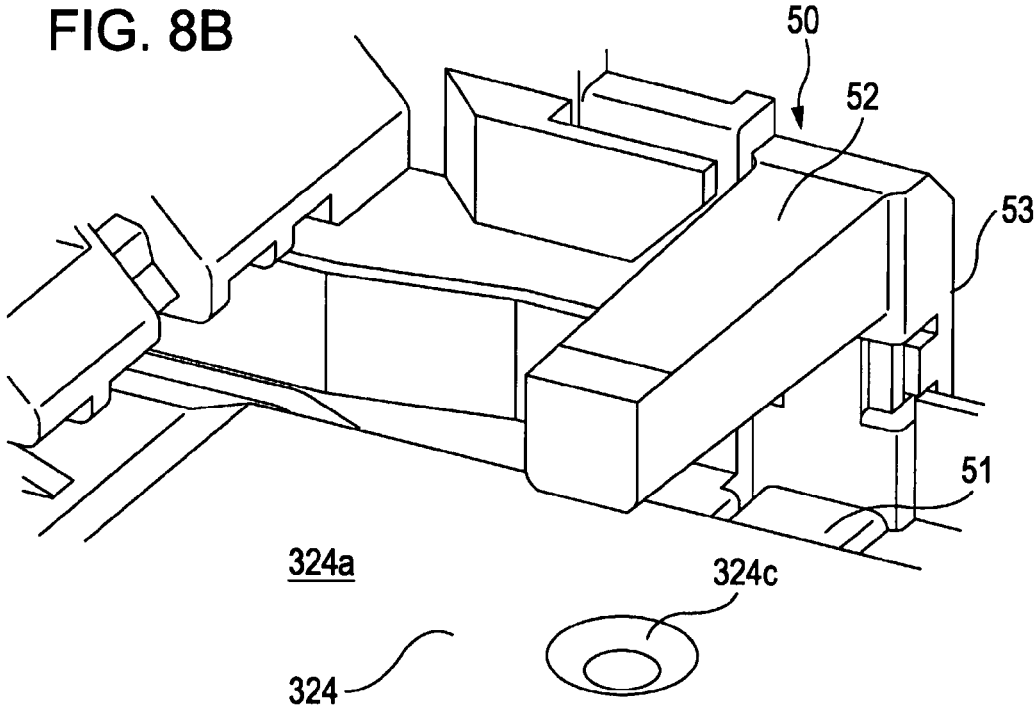
FIG. 8B is a view illustrating another example of a communication hole for allowing the light-emitting element to be exposed.

Meanwhile, the main function of the guide ribs 323 is to space the sheet S to be transported, apart from the light-emitting unit 51 by the sheet guide faces 323*a*. Considering this point, as shown, for example, in FIG. 8A, the surface (sheet guide face 324*a*) of the bottom guide member 34 may be constituted by a simple flat surface, and a communication hole 324*b* that communicates this surface 324*a* with the sensor attachment portion 321*b* (space), i.e., a communication hole 324*b* for allowing the light-emitting element 511 to be exposed through this surface may be provided. In this case, sheet S can be hardly caught by chamfering an edge on the side of the sheet guide face 324*a* like another communication hole 324*c* shown in FIG. 8B.

Conclusion

As can be understood from the above description, because the bottom guide member 32 is provided with the guide ribs 323 for spacing the sheet S to be transported apart from the light-emitting unit 51, a problem that the sheet S to be transported may be caught in the light-emitting unit 51 can be prevented. Thereby, sheet S can be transported smoothly. Also, since the guide ribs 323 is are integrally molded with the guide member body 321, any joint can be eliminated. Even in this point, sheet S can be transported smoothly. In addition, as mentioned above, as long as there is no influence of outside light, the light-receiving unit 52 may be attached to the sensor attachment portion 321*b*, and the light-emitting unit 51 may be arranged above the arrangement space 52.

Structure on the Side of Top Guide Member 31

Outline

As mentioned above, the top guide member 31 is rotatably attached to the attachment frame 317 (base frame FR). On the other hand, a part (light-receiving unit 52) of the sheet detecting sensor 50 arranged in the arrangement space 314 possessed by the top guide member 31 is in a fixed state. This is because another part (light-emitting unit 51) of the sheet detecting sensors 50 is fixedly attached to the sensor attachment portion 321*b* of the bottom guide member 32. As such, since the light-receiving unit 52 in a fixed state is arranged in the top guide member 31 to be rotated, a gap is generated between the top guide member 31 and the light-receiving unit 52. When sheet S is caught in this gap, there is a fear that any hindrance to transport may occur. In consideration of this point, in this printer 1, the gap between the top guide member 31 and the light-receiving unit 52 is covered with a guide film 61 (corresponding to a film member). Hereinafter, the structure on the side of the top guide member 31 will be described mainly about this point.

Guide Piece

Figure 9:
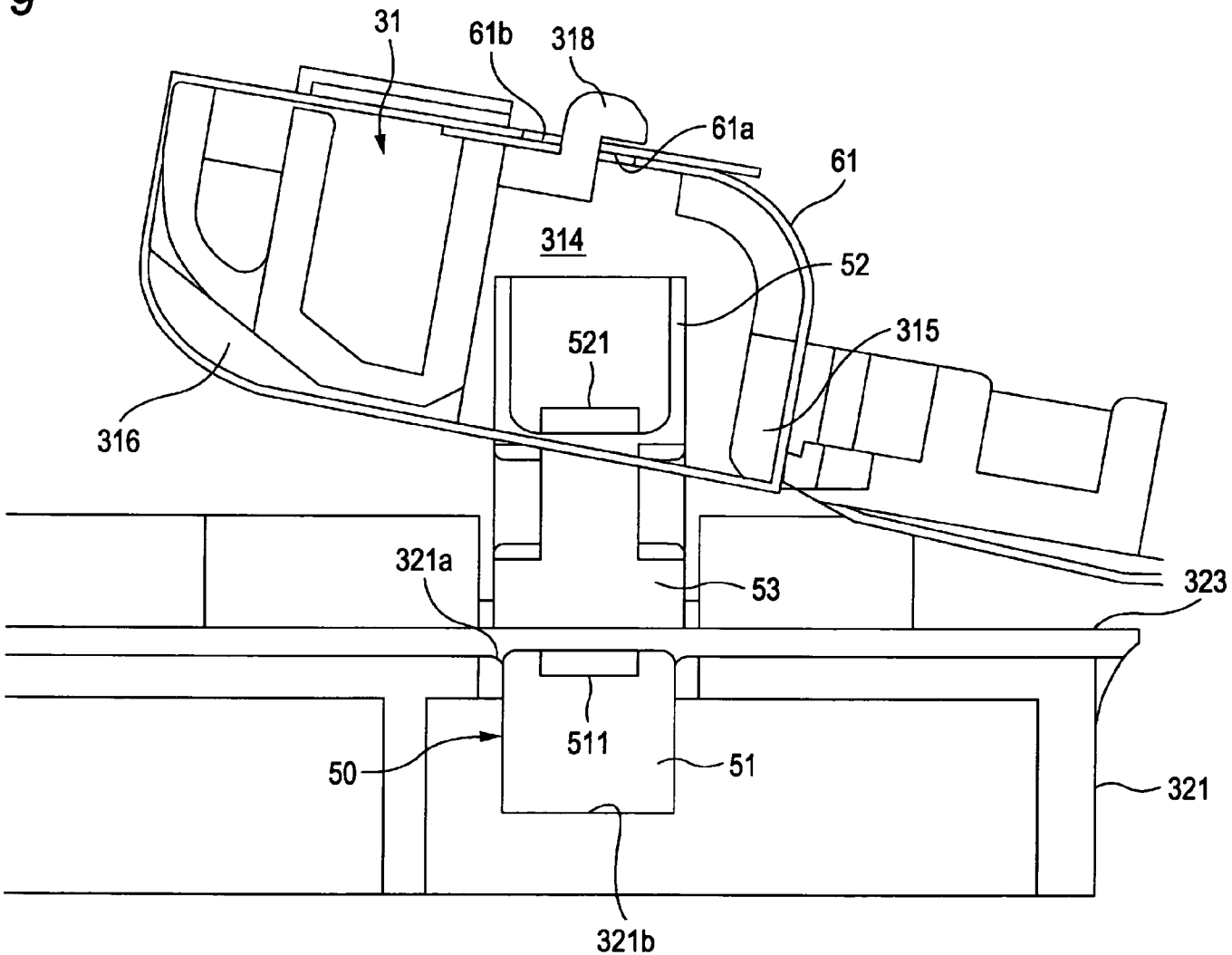
FIG. 9 is an enlarged view illustrating the top guide member and the sheet detecting sensor.

As shown in FIG. 9, the top guide member 31 as a medium guide member has a first guide piece 316 provided on the side of the first sheet feed unit 10, and a second guide piece 315 provided on the side of the transport roller 322. With respect to the sheet S transported towards the transport roller 322 from the first sheet feed unit 10, the first guide piece 316 is located closer to the near side in the transport direction of the sheet S than the light-receiving unit 52. Therefore, the first guide piece 316 functions as a near-side guide piece for the sheet S transported towards the transport roller 322 from the first sheet feed unit 10. Also, with respect to the sheet S transported towards the transport roller 322 from the first sheet feed unit 10, the second guide piece 315 is located closer to the deep side in the transport direction of the sheet S than the light-receiving unit 52. Therefore, the second guide piece 315 functions as a deep-side guide piece for the sheet S transported towards the transport roller 322 from the first sheet feed unit 10. In addition, if this printer 1 is mounted with an reversing unit (not shown), sheet S is transported in a direction opposite to the junction guide unit 30 from the platen PL when after printing of an image onto one surface of the sheet is completed, and then printing onto the other surface of the sheet is performed. In this case, the first guide piece 316 functions as a deep-side guide piece, and the second guide piece 315 functions as a near-side guide piece. For convenience, in the following description, a case where the first guide piece 316 functions as a near-side guide piece, and the second guide piece 315 functions as a deep-side guide piece will be described.

Guide Film 61

The guide film 61 is wound so as to cover the first guide piece 316 and the second guide piece 315. That is, the guide film 61 is laid between the first guide piece 316, and the second guide piece 315. This guide film 61 is provided for smoothly guiding sheet S in the transport direction. By bridging the guide film 61 between the first guide piece 316, and the second guide piece 315, a gap generated with the light-receiving unit 52 can be covered with certainty. As this guide film 61, a strip-like film made of resin is used suitably. A PET film is used in this embodiment. From the viewpoint of the balance between strength and winding, a resin film of about 0.05 to 0.3 mm in thickness shown by a symbol "d" in FIG. 11 is suitably used. An opening of the arrangement space 314 on the side of the bottom guide member 32 is covered with this guide film 61. In other words, a portion of the arrangement space 314 on the side of the bottom guide member 32 is partitioned.

Figure 12A:
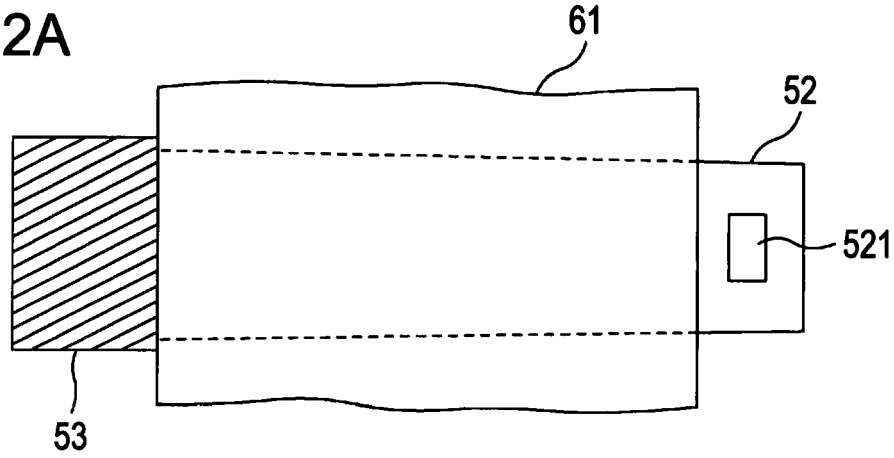
FIG. 12A is a view illustrating the relationship in size between the guide film and the light-receiving unit, in the first embodiment.

In addition, as shown in FIG. 12A, the guide film 61 in this embodiment covers a leading end of the light-receiving unit 52, and more specifically, a portion nearer to the connecting portion 53 than the light-receiving element 521. For example, as shown in FIG. 11, the gap between the light-receiving unit 52 and the first guide piece 316 and the gap between the light-receiving unit 52 and the second guide piece 315 are covered away from an optical axis Lx that connects the light-emitting element 511 and the light-receiving element 521. Thus, sheet S can be guided without damaging the detection sensitivity of the sheet detecting sensor 50 by covering a portion of the light-receiving unit 52 away from the optical axis Lx. That is, the corners of the sheet S that readily causes catching during transport of sheet S can be guided by this guide film 61.

Attachment Procedure

Next, the outline of the procedure of attaching the bottom guide member 32, the sheet detecting sensor 50, and the top guide member 31 will be described. As shown in FIG. 4, in this printer 1, the sheet detecting sensor 50 is first attached to the bottom guide member 32. Then, the bottom guide member 32 in a state where the sheet detecting sensor 50 is attached is attached to the frame of the printer 1. This results from the fact that the bottom guide member 32 is a large-sized part in the printer 1. That is, this is because workability can be improved by attaching large-sized parts in a step where there is a margin of space. When the bottom guide member 32 has been attached, the top guide member 31 is attached to the base frame FR. In addition, a plurality of the top guide members 31 are attached in addition to the top guide member for an end shown in FIG. 5.

Figure 10A:
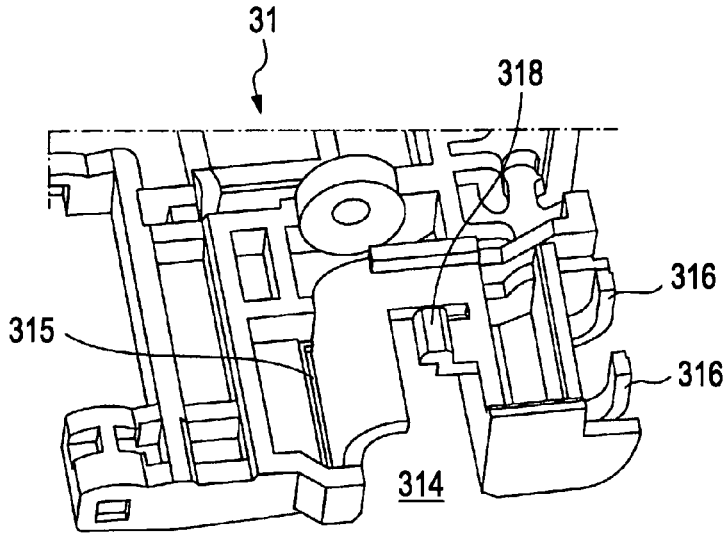
FIG. 10A is a view illustrating the top guide member in a state where a guide film is not wound therearound.
Figure 10B:
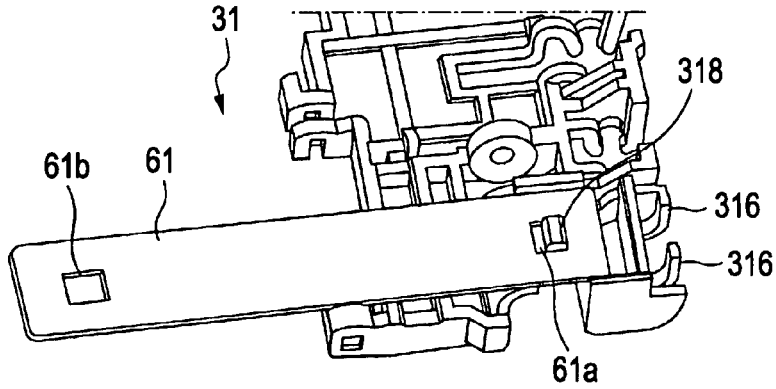
FIG. 10B is a view illustrating a state where one mounting hole is inserted onto a protruding portion.
Figure 10C:
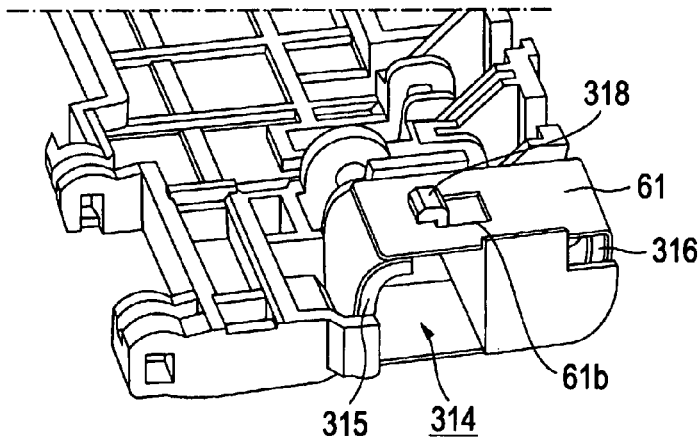
FIG. 10C is a view illustrating a state where wound the guide film is wound around the top guide member, and another mounting hole is inserted onto the protruding portion.

Then, the guide film 61 is wound around the top guide member 31 for an end before this member is attaching to the base frame FR. As shown in FIGS. 10A and 10B, when the guide film 61 is wound, an operator first inserts one mounting hole 61*a* formed in a one longitudinal end of the guide film 61 onto a protruding portion 318. When one mounting hole 61*a* has been inserted, an operator, as shown in FIG. 10C, will wind the guide film 61 along the second guide piece 315, and the first guide piece 316. That is, the operator winds the guide film 61 so as to cover the second guide piece 315 and the first guide piece 316 from the outside. Then, another mounting hole 61*b* formed in the other end of the guide film 61 is inserted onto the protruding portion 318. At this time, the first guide piece 316 gives a tension to the guide film 61 by its elasticity. Therefore, the guide film 61 can be wound without any looseness. Further, the guide film 61 can be attached with certainty. The winding of the guide film 61 is completed by the above procedure. However, in this embodiment, the protruding portion 318 is provided opposite the light-emitting unit 51, and both longitudinal ends of the guide film 61 are fixed in positions on the side of the protruding portion 318. Therefore, the portion of the guide film 61 on the side of the light-emitting unit 51 becomes as a smooth surface without a joint or a height difference. Accordingly, sheet S can be guided smoothly.

Modified Example

Meanwhile, as shown in FIG. 12A, the guide film 61 in this embodiment does not cover a leading end of the light-receiving unit 52, and the light-receiving element 521 is arranged in a position deviated from the guide film 61. Therefore, since the optical axis Lx that connects the light-emitting element 511 with the light-receiving element 521 is not covered, there is an advantage that, and thus excellent detection sensitivity is obtained. Also, because the guide film 61 may be a material having no translucency, there is also an advantage that the degrees of freedom in selection of a material increases. Further, the guide film 61 is attached in a state where it is wound around the top guide member 31. In this configuration, the guide film 61 can be attached by inserting one mounting hole 61*a* onto the protruding portion 318, and winding the guide film 61, and then inserting the other mounting hole 61*b* onto the protruding portion 318. Also, since drying, etc. is required, operation can be finished in a short time, and production efficiency can be enhanced. However, the structure and attachment method of the guide film 61 are not limited to these examples.

Figure 12B:
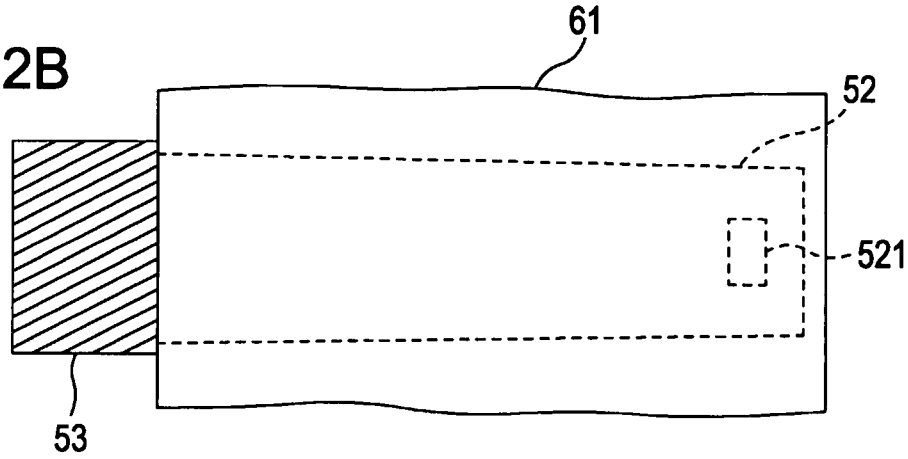
FIG. 12B is a view illustrating a modified example of the guide film.

First, as for the structure of the guide film 61, as shown in FIG. 12B, the whole face (attachment face of the light-receiving element 521) that faces the light-emitting unit 51 in the light-receiving unit 52 may be covered with the guide film 61. In this case, the light-receiving element 521 is also covered with the guide film 61. Accordingly, catching of sheet S can be prevented more with certainty, and sheet S can be guided smoothly. Further, the light-receiving element 521 can also be protected. In addition, in this configuration, the guide film 61 is interposed in the optical axis Lx that connects the light-emitting element 511 and the light-receiving element 521. Therefore, it is necessary to make the guide film 61 from a material having translucency from the viewpoint of ensuring detection sensitivity. In order to improve the detection sensitivity, it is preferable to make the guide film 61 from a transparent material.

Figure 12C:
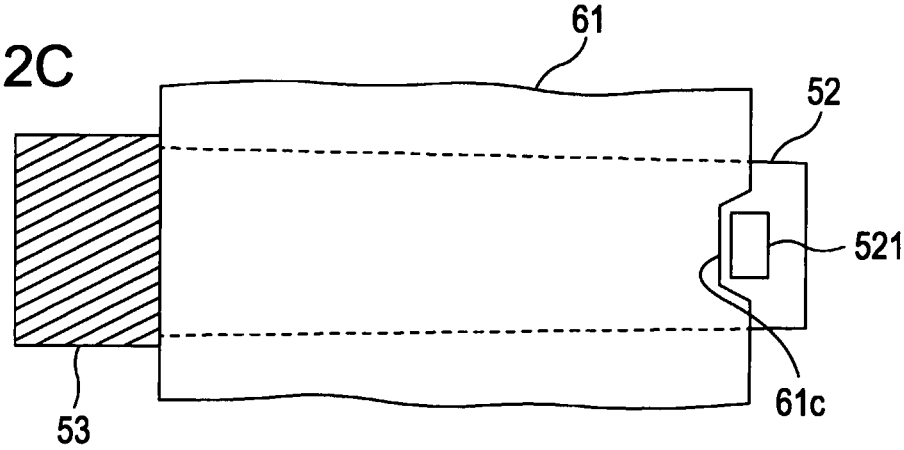
FIG. 12C is a view illustrating another modified example of the guide film.

Further, as shown in FIG. 12C, a cutout portion 61*c* may be provided in the portion of the guide film 61 corresponding to the light-receiving element 521 so as to allow the light-receiving element 521 to be exposed through the light-emitting element 511. In this configuration, the area of a portion in the light-receiving unit 52 covered with the guide film 61 can be increased compared with the configuration of FIG. 12A. Therefore, catching of sheet S can be prevented more certainly, and sheet S can be guided smoothly. In addition, since the guide film 61 does not cover the optical axis Lx, detection sensitivity can be kept well, and various materials, such as a coloring material, can be used. In addition, an opening for allowing the light-receiving element 521 to be exposed through the light-emitting element 511 may be provided except the cutout portion.

Figure 13A:
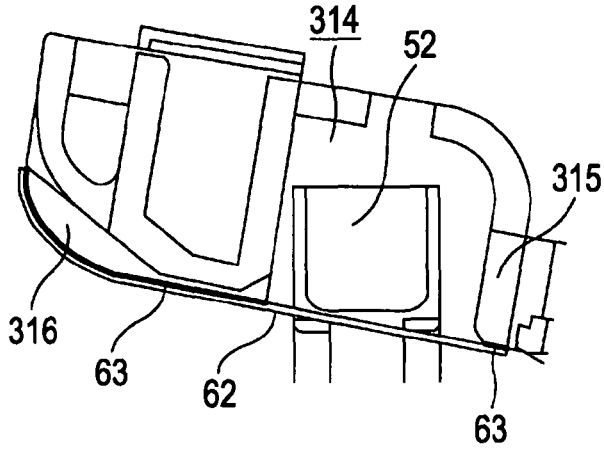
FIG. 13A is a view illustrating a modified example in which a guide film is bonded to the top guide member.
Figure 13B:
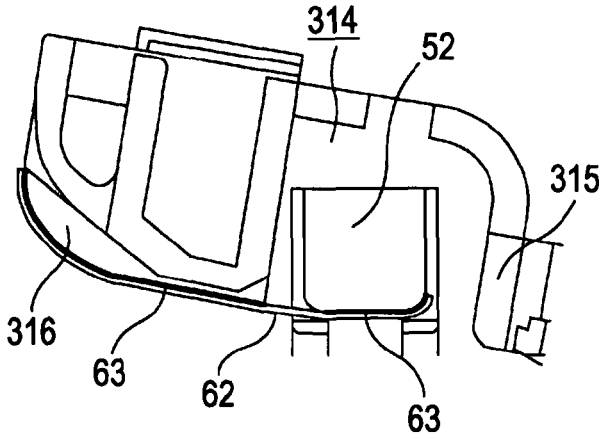
FIG. 13B is a view illustrating another modified example in which a guide film is bonded to the top guide member.
Figure 13C:
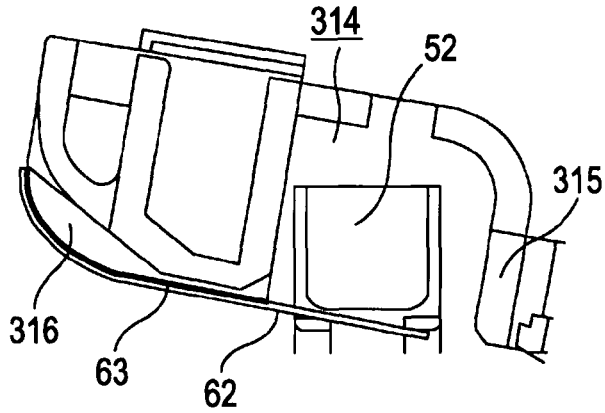
FIG. 13C is a view illustrating still another modified example in which a guide film is bonded to the top guide member.

Next, as for the attachment method of the guide film 61, in this embodiment, the guide film is fixed by winding the guide film 61 around the top guide member 31, and by inserting the mounting holes 61*a* and 61*b* provided in both longitudinal ends of the guide film 61 onto projections on the side of the top guide member 31. In this regard, the guide film 62 may be fixed by bonding. For example, as shown in FIG. 13A, a portion of the guide film 62 may be bonded to the first guide piece 316 with adhesive 63, and another portion of the guide film may be bonded to the second guide piece 315 with adhesive 63. Further, if reverse transport (transport from the platen PL towards the first sheet feed unit 10) of sheet S is not taken into consideration, as shown in FIG. 13B, a portion of the guide film 62 may be bonded to the first guide piece 316 (near-side guide piece), and another portion of the guide film may be bonded to the light-emitting unit 51. Otherwise, as shown in FIG. 13C, a portion of the guide film 62 may be bonded to the second guide piece 316 (near-side guide piece), and the gap between the top guide member and the light-receiving unit 52 may be covered by a non-adhesion portion in the guide film 62. Also, if the fixing method by bonding is used, the guide film 62 can be arranged even in a restricted narrow space. Further, the guide film 62 can be attached with certainty. Further, if the gap between the top guide member and the light-receiving unit 52 is covered by a non-adhesion portion in the guide film 62, the non-adhesion portion is a free end, and the portion is bent. Thus, even if the portion touches the light-receiving unit 52, it will hardly affect the unit. Therefore, the degree of freedoms in the arrangement of the light-receiving unit 52 can be increased.

Conclusion

As can be understood from the above description, since the first guide piece 316 (near-side guide piece) and the second guide piece 315 (deep-side guide piece) possessed by the top guide member 31 and the gap between the top guide member and the light-receiving unit 52 possessed by the sheet detecting sensor 50 are covered with the guide films 61 and 62, a problem that sheet S may enter this gap can be prevented.

Other embodiments

Although the printer 1 as a medium transport apparatus is described in the aforementioned embodiments, the medium transport apparatus may be apparatuses other than the printer 1. Further, the aforementioned embodiments are provided for making the invention easily understood, and should not be interpreted as limiting the invention. The invention can be changed and improved without departing from the spirit thereof, and it is needless to say that the equivalents are included in the invention. In particular, the embodiments to be described below are also included in the invention. Guide ribs 323 and guide film 61

In the aforementioned embodiment, the guide ribs 323 are provided on the bottom guide member 32, and the guide films 61 and 62 are attached to the top guide member 31. This results from the structure of the printer 1. That is, structurally, the probability that sheet S may contact the bottom guide member 32 is higher than the probability that the sheet may contact the top guide member 31. The reason is as follows. That is, the sheet S guided from the first sheet feed unit 10 has a high probability of contacting the bottom guide member 32 because it is transported obliquely downward, and the sheet S transported from the second sheet feed unit 20 is corrected in posture, and is transported in a substantially horizontal state by the second hopper 26, after the sheet has passed through the position of the second feed roller 23. Thus, in the aforementioned embodiments, the guide ribs 323 having relatively high strength are provided on the bottom guide member 32. Also, the guide films 61 and 62 with easy attachment are attached to the top guide member 31. However, the invention is not limited to this configuration. For example, guide films may be attached to the bottom guide member 32, and guide ribs may be provided in the top guide member 31. Moreover, guide ribs or guide films may be attached, on each of the top guide member 31 and the bottom guide member 32.

Further, in the aforementioned embodiments, the guide ribs 323 and the guide member body 321 are manufactured by integral molding. However, the invention is not limited to this configuration. For example, the guide ribs 323 and the guide member body 321 may be manufactured separately, or both of them may be joined together. In this case, from the viewpoint of preventing catching of sheet S, it is desirable to smooth a portion between both of them.

Medium

A medium to be transported by the medium transport apparatus is not limited to sheet S. For example, the medium may be a board sheet and an OHP sheet. Further, the medium may be a disk-like medium, such as CD-R or DVD-R.

What is claimed is:

1. A medium transport apparatus comprising:

a medium detection sensor having a light-emitting unit and a light-receiving unit that are arranged apart from each other by a predetermined distance, and that changes the signal level of a detection signal output from the light-receiving unit according to the presence/non-presence of a medium between the light-emitting unit and the light-receiving unit;

a transporting member, that transports the medium, attached on a downstream side of the medium detection sensor in a transport direction, wherein the transporting member has a transport roller, and a press roller arranged on the transporting member;

a regulating member, that regulates the transport direction of the medium, attached on an upstream side of the medium detection sensor in a transport direction; and a junction guide unit that is arranged in the middle of a transport path and that has a bottom guide member having a medium guide face that guides the medium on the side of the rear face of the medium, a top guide member that guides the medium on the side of the front face of the medium, and a sensor attachment portion to which the medium detection sensor is attached so that the medium guide face of the bottom guide member is configured to be arranged at a position closer to either the light-emitting unit or the light-receiving unit, the medium detection sensor is arranged in a position within a range in which a virtual straight line that connects a regulating-member-side contact point where the medium contacts the regulating member nearest to the transporting member, and a transporting-member-side contact point where the transport roller and the press roller contact each other passes between the light-emitting unit and the light-receiving unit, the medium detection sensor is adapted such that the light-emitting unit is arranged on the bottom guide member side, and the light-receiving unit is arranged on the top guide member side, and the top guide member has a first guide piece and a second guide piece, wherein a gap between the light-receiving unit and the first guide piece and a gap between the light-receiving unit and the second guide piece are covered with a resin film.

2. The medium transport apparatus according to claim 1, wherein the top guide member has a roller attachment portion for attaching the press roller, and the top guide member is rotatably attached so as to move the press roller attached to the roller attachment portion, in a direction of being pressed against the transport roller, and in a direction away from the transport roller.

3. The medium transport apparatus according to claim 1, wherein the top guide member is arranged above the bottom guide member.

4. The medium transport apparatus according to claim 1, wherein a bottom of the virtual straight line that connects a regulating-member-side contact point and a transporting-member-side contact point forms an acute angle with the bottom guide member.

* * * * *